US012758072B2

(12) United States Patent
Pruiett et al.

(10) Patent No.: US 12,758,072 B2
(45) Date of Patent: Oct. 13, 2026

(54) EXTRACTION CLEANER SYSTEMS, METHODS, AND DEVICES WITH DISPOSABLE ABSORBENT PADS IN RECOVERY PATHWAY

(71) Applicant: BISSELL Inc., Grand Rapids, MI (US)

(72) Inventors: Jason W. Pruiett, Grand Rapids, MI (US); Brian Robert Dexter, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/225,932

(22) Filed: Jul. 25, 2023

(65) Prior Publication Data

US 2024/0032757 A1 Feb. 1, 2024

Related U.S. Application Data

(60) Provisional application No. 63/392,293, filed on Jul. 26, 2022.

(51) Int. Cl.
*A47L 11/30* (2006.01)
*A47L 11/40* (2006.01)

(52) U.S. Cl.
CPC ..... *A47L 11/30* (2013.01); *A47L 11/4016* (2013.01); *A47L 11/4083* (2013.01); *A47L 11/4005* (2013.01)

(58) Field of Classification Search
CPC .. A47L 11/30; A47L 11/4016; A47L 11/4083; A47L 11/4005; A47L 7/0014;
(Continued)

(56) References Cited

U.S. PATENT DOCUMENTS 6,125,498 A 10/2000 Roberts et al.
6,685,056 B1 2/2004 Argentieri et al.
(Continued)

FOREIGN PATENT DOCUMENTS

CN 108348125 A 7/2018
CN 208822660 U 5/2019
(Continued)

OTHER PUBLICATIONS

Translation of KR 19990040376 U (Year: 1999).*
(Continued)

*Primary Examiner* — David S Posigian
*Assistant Examiner* — Steven Huang
(74) *Attorney, Agent, or Firm* — Price Heneveld LLP

(57) ABSTRACT

An extraction cleaner system includes a housing with a fluid delivery pathway and a fluid recovery pathway. A suction source is disposed within the housing and is fluidly connected to the fluid recovery pathway. The suction source is configured to create a fluid pressure vacuum. A liquid source is carried by the housing and is fluidly connected to the fluid delivery pathway. The liquid source is configured to contain and dispense a liquid. A suction nozzle is fluidly connected to the fluid recovery pathway upstream from the suction source. The suction nozzle is configured to draw therethrough the liquid dispensed from the liquid source. The suction nozzle defines a pad compartment located within the fluid recovery pathway and an absorbent pad is removably stored inside the pad compartment.

16 Claims, 10 Drawing Sheets

(58) Field of Classification Search
CPC .... A47L 9/0686; A47L 9/0009; A47L 9/0626; A47L 9/006; A47L 11/4041; A47L 11/4044; A47L 11/4027; B08B 3/02; B08B 3/024; B08B 3/026; B08B 3/028; B08B 2203/02; B08B 2203/0229; E01H 1/103
USPC ..... 134/104.2, 104.4, 110, 172, 198
See application file for complete search history.

(56) References Cited

U.S. PATENT DOCUMENTS

| | | | | |
|---|---|---|---|---|
| 6,968,593 | B1 | 11/2005 | Lenkiewicz et al. | |
| 7,784,149 | B2 | 8/2010 | Schwarz et al. | |
| 8,661,608 | B2 | 3/2014 | Knopow et al. | |
| 9,560,948 | B2 | 2/2017 | Huang et al. | |
| 9,808,133 | B2 | 11/2017 | Lubbers et al. | |
| 2004/0134016 | A1 | 7/2004 | Kisela et al. | |
| 2007/0039125 | A1* | 2/2007 | Kang | A47L 9/122 15/351 |
| 2008/0263813 | A1* | 10/2008 | Han | A47L 9/1691 15/334 |
| 2010/0024157 | A1* | 2/2010 | Vernon | A47L 5/28 15/403 |
| 2010/0126129 | A1* | 5/2010 | Kim | A47L 9/122 55/494 |
| 2014/0311107 | A1* | 10/2014 | Sobel | A47L 9/127 55/379 |
| 2015/0027313 | A1* | 1/2015 | Hwang | B01D 46/0038 55/499 |
| 2018/0360287 | A1* | 12/2018 | Gray | A47L 13/22 |
| 2019/0053676 | A1* | 2/2019 | Mallon | A47L 9/18 |
| 2021/0085147 | A1 | 3/2021 | Yu | |
| 2021/0113047 | A1* | 4/2021 | Zhao | A47L 11/4008 |
| 2021/0401248 | A1* | 12/2021 | King | A47L 5/24 |

FOREIGN PATENT DOCUMENTS

| | | | | |
|---|---|---|---|---|
| CN | 112312815 | A | 2/2021 | |
| DE | 1748322 | U | * 7/1957 | |
| DE | 69712933 | T2 | 1/2003 | |
| DE | 202015105894 | U1 | 2/2017 | |
| EP | 1095610 | A2 | 5/2001 | |
| EP | 2992798 | A1 | 3/2016 | |
| EP | 3409159 | B1 | 9/2021 | |
| EP | 3409160 | B1 | 4/2022 | |
| KR | 19990040376 | U | * 11/1999 | |
| RU | 93652 | U1 | * 5/2010 | |
| WO | WO-2007099052 | A1 | * 9/2007 | A47L 9/122 |

OTHER PUBLICATIONS

Translation of DE 1748322 U (Year: 1957).*
Translation of WO 2007099052 A1 (Year: 2007).*
Translation of RU 93652 U1 (Year: 2010).*

* cited by examiner

EXTRACTION CLEANER SYSTEMS, METHODS, AND DEVICES WITH DISPOSABLE ABSORBENT PADS IN RECOVERY PATHWAY

CROSS-REFERENCE TO RELATED APPLICATION

This application claims priority to and the benefit under 35 U.S.C. § 119(e) of U.S. Provisional Application No. 63/392,293, filed on Jul. 26, 2022, entitled "EXTRACTION CLEANER SYSTEMS, METHODS, AND DEVICES WITH DISPOSABLE ABSORBENT PADS IN RECOVERY PATHWAY," the disclosure of which is hereby incorporated herein by reference in its entirety.

INTRODUCTION

The present disclosure relates generally to vacuum-based systems that generate suction to remove assorted debris from surfaces. In particular, aspects of this disclosure relate to electric upright, pod-style, and handheld wet-extraction portable deep cleaners.

A traditional vacuum cleaner is an electro-pneumatic device that generates a gaseous pressure vacuum for cleaning hard surfaces, such as tile and wood flooring, and soft surfaces, such as carpet and upholstery. While conventionally built as a "dry" type cleaning apparatus limited to dirt, dust, and solid debris, some surface-cleaning vacuums are adapted as "wet" type fluid recovery systems that also extract stains and other liquids from a surface. Many modern wet extraction cleaners—also known as a "deep cleaner" or "DC"—come equipped with a liquid delivery system and, optionally, a liquid recovery and stowage system. The delivery system expels a cleaning solution onto the surface to be cleaned, while the liquid recovery system extracts spent cleaning liquid and debris from the surface and may stow the extracted liquid/debris in a recovery tank.

As part of a deep cleaner's liquid delivery system, a fluid-tight supply tank or a disposable solution container is mounted to the body for storing and dispensing a cleaning solution with an application-suitable composition (e.g., water, surfactants, stabilizers, fragrances, foaming agents, and/or detergents). When desired, a user of the deep cleaner selectively dispenses the cleaning solution from the supply tank/container through a fluid supply conduit that extends to fluid dispensers associated with a foot of the cleaner (upright deep cleaners), through a hose to fluid dispensers associated with a wand or tool (portable and upright deep cleaners), or to fluid dispensers carried by a body of the cleaner (handheld deep cleaners). The solution may be expelled onto each surface to be cleaned through one or more spray orifices associated with an accessory tool, a cleaner foot, a nozzle head, or an external spray nozzle attached to a wand that extends between the accessory tool and the hose. A pneumatic pressure source located aboard the deep cleaner generates sufficient suction forces to extract spent solution, staining liquid, and entrained debris from the surface.

SUMMARY

Presented herein are removable pads for fluid recovery pathways of vacuum-based cleaning systems, methods for making and methods for using disclosed vacuum systems and pads, and wet-extraction type deep cleaners equipped with disposable absorbent pads. In a non-limiting example, there are presented battery-operated, handheld (HH) portable deep cleaners (PDC) with a disposable or washable liquid-absorbent pad removably positioned inside the PDC's liquid suction nozzle. The HH PDC is equipped with a fluid delivery system, which may be typified by a liquid supply tank, a liquid pump, and a spray nozzle, as well as a liquid recovery system, which may be typified by a suction pump, a recovery nozzle, and an absorbent pad into which is drawn recovered liquid and debris. For at least some designs, the absorbent pad can be used in cooperation with or in place of a recovery tank. The absorbent pad may be packaged entirely inside a dedicated pad pocket within a nozzle head of the PDC, substantially filling a select segment of the PDC's fluid recovery pathway to absorb extracted fluid/soil. The absorbent pad may be removed from the nozzle head and either cleaned or discarded after use; a new or cleaned absorbent pad may then be inserted for subsequent use of the PDC.

According to one aspect of the present disclosure, an extraction cleaner system includes a housing with a fluid delivery pathway and a fluid recovery pathway. A suction source is disposed within the housing and is fluidly connected to the fluid recovery pathway. The suction source is configured to create a fluid pressure vacuum. A liquid source is carried by the housing and is fluidly connected to the fluid delivery pathway. The liquid source is configured to contain and dispense a liquid. A suction nozzle is fluidly connected to the fluid recovery pathway upstream from the suction source. The suction nozzle is configured to draw therethrough the liquid dispensed from the liquid source. The suction nozzle defines a pad compartment located within the fluid recovery pathway and an absorbent pad is removably stored inside the pad compartment.

According to another aspect of the present disclosure, a handheld extraction cleaner includes a unitary body with a carry handle. The unitary body contains a fluid delivery pathway and a fluid recovery pathway. A battery is carried by the unitary body. A suction source is mounted inside the unitary body, electrically connected to the battery, and fluidly connected to the fluid recovery pathway. The suction source is configured to create a fluid pressure vacuum. A liquid source is mounted to the unitary body, is fluidly connected to the fluid delivery pathway, and is configured to contain and dispense a liquid cleaning solution. A suction nozzle is mounted to the unitary body and is fluidly connected to the fluid recovery pathway upstream from the suction source. The suction nozzle is configured to draw the liquid cleaning solution dispensed from the liquid source. The suction nozzle defines a pad compartment located within the fluid recovery pathway and an absorbent pad is removably contained inside the pad compartment.

According to still another aspect of the present disclosure, a removable pad assembly for a vacuum cleaner system has a recovery pathway, a suction source fluidly connected to the recovery pathway, and a suction nozzle fluidly connected to the recovery pathway upstream from the suction source that defines a pad compartment located within the recovery pathway. The removable pad assembly includes an elongated and absorbent pad body that defines an airflow pathway and is configured to removably store inside the pad compartment of the suction nozzle. A non-permeable outer layer at least partially surrounds the elongated and absorbent pad body.

Aspects of this disclosure are directed to vacuum-based cleaning systems with removable pads for absorbing dirt, debris, liquids, etc. As used herein, the terms "extraction cleaner" and "deep cleaner"—including variations and permutations thereof — may be used interchangeably and synonymously to include any relevant vacuum-based cleaner system, including upright, handheld, central, and pod architectures in both corded and cordless configurations, as some non-limiting examples. Additional aspects of this disclosure are directed to portable deep cleaners with absorbent PDC pads removably located within a recovery pathway of the PDC. Aspects of this disclosure are also directed to manufacturing processes and control logic for making/using any of the disclosed cleaner systems, devices, and removable pads. Additional aspects of this disclosure are also directed to removable pads for recovery pathways of vacuum-based cleaning systems.

According to another aspect of the present disclosure, method for assembly an extraction cleaner includes, in any order and in any combination with any of the above and below disclosed options and features: receiving a cleaner housing with a fluid delivery pathway and a fluid recovery pathway; attaching a suction source to the cleaner housing, the suction source configured to create a fluid pressure vacuum; fluidly connecting the suction source to the fluid recovery pathway; and attaching a liquid source to the cleaner housing. The liquid source is configured to contain and dispense a liquid. The method further includes fluidly connecting the liquid source to the fluid delivery pathway; and fluidly connecting a suction nozzle to the fluid recovery pathway upstream from the suction source. The suction nozzle is configured to draw therethrough the liquid dispensed from the liquid source and defines a pad compartment located within the fluid recovery pathway. The method also includes removably storing an absorbent pad inside the pad compartment.

For any of the disclosed systems, methods, pads, and devices, the suction nozzle may include a compartment door that is disposed over the pad compartment and covers the absorbent pad. The compartment door may include pivot pins that project transversely from opposite sides of the compartment door near a longitudinal end thereof. In this instance, the suction nozzle may include pin slots that each receive therein a respective one of the pivot pins to thereby pivotably mount the compartment door to the suction nozzle. An actuator trigger may be operatively connected to the compartment door and manually operable to release the compartment door to thereby allow the compartment door to transition from a closed position to an open position. As another option, a finger slot may be integral with or otherwise attached to the compartment door and manually operable to move the compartment door from a closed position to an open position. When in the open position, the pad compartment is accessible, e.g., for removal/insertion of the pad. Conversely, when in the closed position, the pad compartment is not accessible, e.g., such that the pad is at least partially sealed inside the recovery pathway. The compartment door may be slidably, pivotably, or removably coupled with a portion of the suction nozzle. In addition, the compartment door may be fabricated from a substantially clear polymeric material through which the absorbent pad is visible.

For any of the disclosed systems, methods, pads, and devices, the absorbent pad may be a multipiece pad assembly with a permeable pad body. In this instance, the pad body may be an elongated and symmetrical structure that defines therein one or more airflow channels that extend longitudinally through the pad body. The pad body may include one or more elongated, liquid-absorbent strips supported on a permeable weave insert. The pad assembly may also include a non-permeable shell that at least partially surrounds the pad body. For instance, the non-permeable shell may include one or more non-permeable plates, each of which attaches to a respective side of the pad body. Optionally, the non-permeable shell may include a single-piece outer casing that surrounds the pad body. The pad assembly may also include a rigid frame that structurally buttresses and at least partially encases the pad body therein. In addition, the pad assembly may include a nozzle seal that is attached to one end of the pad body and defines therethrough a nozzle inlet of the suction nozzle.

For any of the disclosed systems, methods, pads, and devices, a spray nozzle may be fluidly coupled with the fluid delivery pathway downstream from the liquid source. This spray nozzle selectively dispenses therethrough at least some of the liquid contained in the liquid source. If desired, the cleaner housing may include a unitary body with a carry handle. In this instance, the suction source, liquid source, suction nozzle, and absorbent pad are all mounted to the unitary body. As a further option, a recovery tank may be attached to the cleaner housing and fluidly connected to the fluid recovery pathway downstream from the suction nozzle. The recovery tank removably stores therein the liquid that is dispensed from the liquid source and drawn through the suction nozzle.

For any of the disclosed systems, methods, pads, and devices, an agitator may be attached adjacent the suction nozzle. The agitator, which may be in the form of a brush or flexible protuberances, agitates a surface to be cleaned by the extraction cleaner system. The extraction cleaner system may also include an accessory wand through which extends the fluid delivery pathway and the fluid recovery pathway. In this instance, an accessory tool may be removably attached to the accessory wand and the tool may contain the suction nozzle with the absorbent pad removably stored within the pad compartment. An accessory hose may fluidly connect the accessory wand to the suction source.

The above summary does not represent every embodiment or every aspect of the present disclosure. Rather, the summary merely provides an exemplification of some of the novel concepts and features set forth herein. The above features and advantages, and other features and attendant advantages of this disclosure, will be apparent from the following detailed description of illustrated examples and representative modes for carrying out the present disclosure when taken in connection with the accompanying drawings and appended claims. Moreover, this disclosure expressly includes any and all combinations and subcombinations of elements and features presented above and below.

Figure 1:
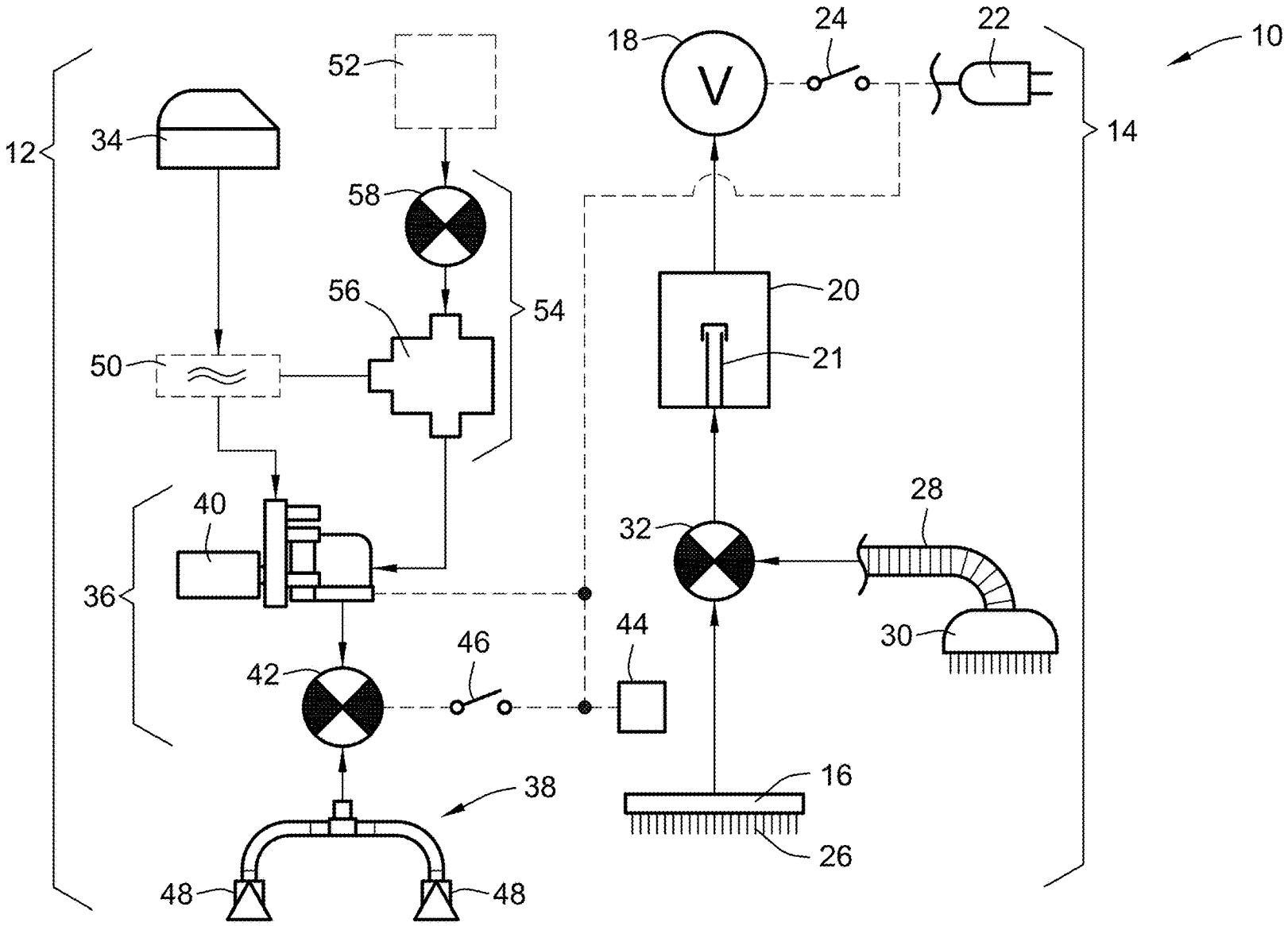
FIG. 1 is a schematic diagram of a representative extraction cleaner system with which novel features of this disclosure may be practiced in accord with aspects of the disclosed concepts.

The present disclosure is amenable to various modifications and alternative forms, and some representative configurations are shown by way of example in the drawings and will be described in detail below. It should be understood, however, that the novel aspects of this disclosure are not limited to the particular forms illustrated in the above-enumerated Figures. Rather, this disclosure covers all modifications, equivalents, combinations, permutations, and alternatives falling within the scope of this disclosure as encompassed, for example, by the appended claims.

DETAILED DESCRIPTION

Representative examples of the disclosure are shown in the various drawings and described in detail below, with the understanding that the descriptions are exemplifications of the disclosed principles and not limitations of the broad aspects of the disclosure. To that end, elements and limitations described herein, but not explicitly set forth in the claims, should not be incorporated into the claims, singly or collectively, by implication, inference, or otherwise. Moreover, the drawings discussed herein may not be to scale, and are provided purely for instructional purposes. Thus, the specific and relative dimensions shown in the figures are not to be construed as limiting.

Additionally, unless specifically disclaimed: the singular includes the plural and vice versa; the words "and" and "or" shall be both conjunctive and disjunctive; the words "any" and "all" shall both mean "any and all"; and the words "including," "containing," "comprising," "having," along with permutations thereof and similar terms, shall each mean "including without limitation." Moreover, words of approximation, such as "about," "almost," "substantially," "generally," "approximately," and the like, may each be used herein in the sense of "at, near, or nearly at," or "within 0-5% of," or "within acceptable manufacturing tolerances," or any logical combination thereof, for example. Lastly, directional adjectives and adverbs, such as front, back, left, right, fore, aft, vertical, horizontal, forward, backward, upward, downward, etc., may be with respect to an extraction cleaner device that is operatively oriented for cleaning a horizontal surface.

Figure 2:
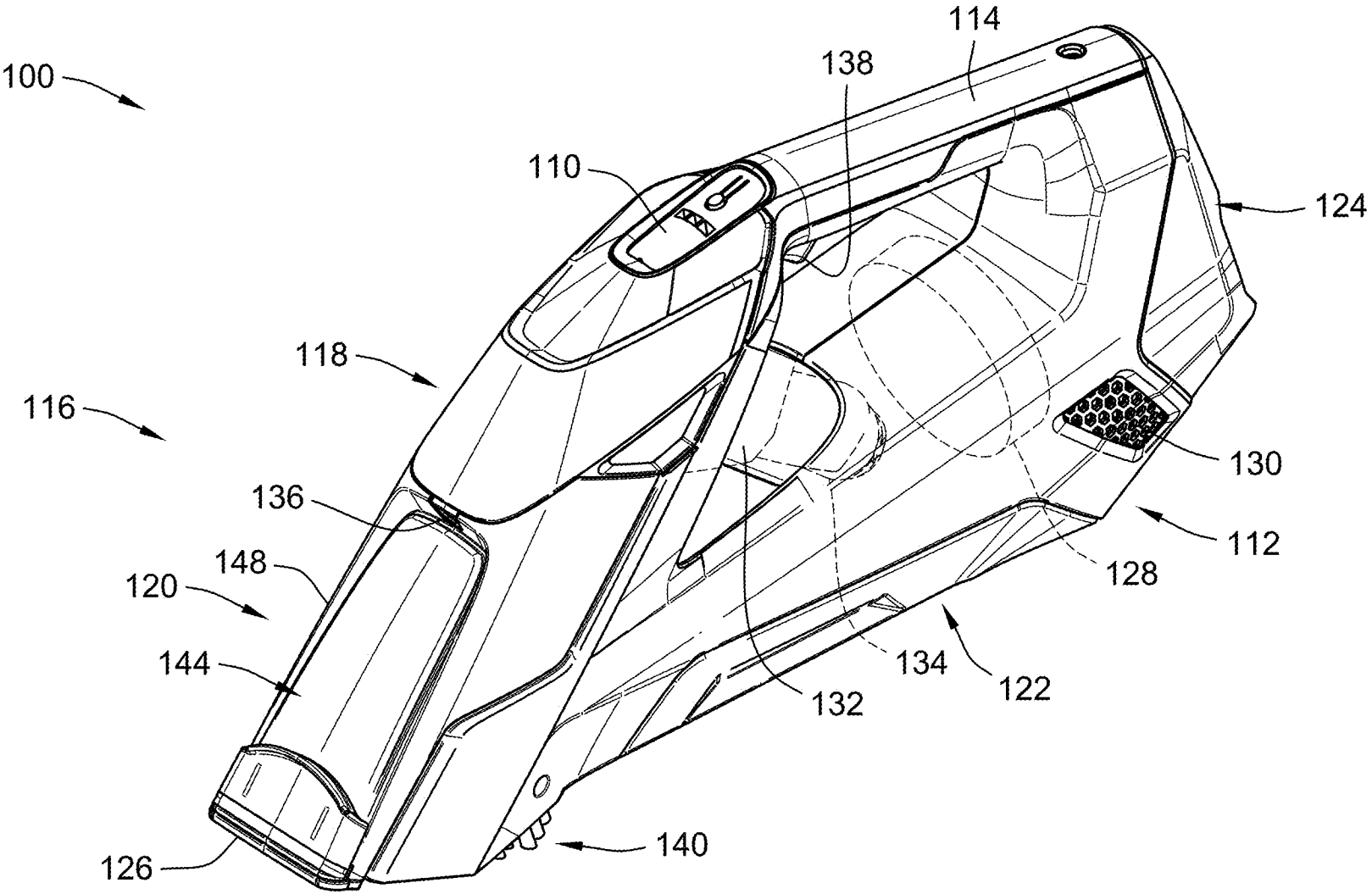
FIG. 2 is an enlarged, top perspective view of a representative handheld, wet-extraction type portable deep cleaner with a recovery tank and a removable absorbent pad in accord with aspects of this disclosure.

For purposes of description herein, the terms "upper," "lower," "right," "left," "rear," "front," "vertical," "horizontal," and derivatives thereof shall relate to the disclosure as oriented in FIG. 2. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to the drawings, wherein like reference numbers refer to like features throughout the several views, there is shown in FIG. 1 a schematic diagram of a representative vacuum-based cleaning system, which is designated generally as 10 and portrayed herein for purposes of discussion as a wet-type extraction cleaner. The illustrated cleaning system 10—also referred to herein as "extraction cleaner" or "deep cleaner"—is merely an exemplary application with which novel concepts of this disclosure may be practiced. As such, it will be understood that aspects and features of the disclosure may be used for other wet-type extraction cleaner configurations and employed for any logically relevant type of vacuum-based cleaning system. Moreover, only select components of the extraction cleaner systems, PDC devices, and removable pads are shown and described in additional detail below. Nevertheless, the systems, pads, and devices discussed herein may include numerous additional and alternative features, and other available peripheral components, for carrying out the various methods and functions of this disclosure.

FIG. 1 illustrates various functional subsystems of a surface cleaning tool in the form of an extraction cleaner 10 system. These functional subsystems may be arranged into any desired configuration, including upright-type extraction devices, canister-type extraction devices, pod-type extraction devices, handheld extraction devices, autonomous and robotic cleaning devices, and commercial cleaners. For instance, any of the herein-described handheld PDCs, such as those shown in FIGS. 2-8, may be adapted to include any of the features of the extraction cleaner 10 illustrated in FIG. 1, and vice versa. By way of example, a PDC may be modified to incorporate one or more attachments, such as a flexible vacuum hose, which can form a portion of the working air conduit between a suction nozzle and a suction source in a wheeled or carried base of an upright, canister, or pod-type extraction device. Such a vacuum hose may be coupled with additional attachments, such as an accessory wand and/or an accessory tool.

The extraction cleaner 10 of FIG. 1 may be a bipartite architecture with a fluid delivery system 12, which stores and selectively dispenses a cleaning fluid to a surface to be cleaned, and a fluid recovery system 14, which removes spent cleaning fluid and debris from the surface to be cleaned and stores the recovered cleaning fluid and debris. In this instance, the illustrated fluid recovery system 14 may be composed of an upstream-end suction nozzle 16, a downstream-end vacuum-generating suction source 18, and an optional waste-storing recovery container 20. The suction source 18, which may be in the nature of a motor-fan, positive-displacement, or centrifugal-rotodynamic assembly, is fluidly connected to the suction nozzle 16 and, when desired, generates a working air stream for drawing liquid and debris into the fluid recovery system 14. The recovery container 20, which is interposed between the suction nozzle 16 and suction source 18, separates and collects liquid and debris from the working airstream for later disposal. A separator 21 can be packaged inside a portion of the recovery container 20 for separating liquid and entrained debris from the working airstream.

Continuing with the discussion of the representative extraction cleaner 10 system of FIG. 1, the suction source 18 may be any suitable vacuum-generating, electro-mechanical device that is electrically coupled or couplable to a power source 22, such as a rechargeable battery or an electrical outlet. A power switch 24, which may be located between the suction source 18 and the power source 22, is selectively actuable by a user to activate the suction source 18. The suction nozzle 16—through which dirt, debris, spent cleaning solution, etc. is drawn—may be integrated into a base, a tool, or a cleaning head and may be adapted to move over the surface to be cleaned. An optional agitator 26 may be located adjacent to the suction nozzle 16 to disturb the surface to be cleaned so that debris is broken up and more easily ingested into the suction nozzle 16. Some non-limiting examples of agitators include a horizontally oriented rotating brushroll, a vertically oriented rotating brushroll, a stationary brush, an array of flexible protuberances, etc.

The extraction cleaner 10 may operatively interface with any of an assortment of interchangeable attachments and tools to facilitate different cleaning tasks. In FIG. 1, for example, an accessory hose 28 may selectively fluidly couple the suction source 18 to an accessory tool or cleaning attachment 30, such as an extension wand, an upholstery tool, a dusting brush, etc., with a separate suction inlet. A diverter valve assembly 32 is manually operated to selectively redirect fluid communication from the suction source 18 to either the suction nozzle 16 or the accessory hose 28. The accessory hose 28 may also employ a fluid distributor (not shown in FIG. 1) that fluidly connects the fluid delivery system 12 with the tool/attachment 30 to selectively discharge the cleaning fluid therefrom.

The fluid delivery system 12 of the extraction cleaner 10 may be composed of a refillable or interchangeable fluid container 34 at an upstream-end of the fluid delivery system 12, a liquid-dispensing fluid distributor 38 at a downstream-end of the fluid delivery system 12, and a liquid flow-regulating flow control system 36 interposed between the container 34 and distributor 38. The fluid container 34 stores and selectively dispenses therefrom a supply of cleaning fluid. The cleaning fluid may include one or more of any suitable cleaning liquids, such as water, compositions, concentrated detergents, diluted detergents, etc., and mixtures thereof. The flow control system 36 governs the transfer of the cleaning fluid from the container 34 to the distributor 38. In the illustrated configuration, the flow control system 36 employs a unidirectional liquid pump 40 to pressurize the fluid delivery system 12, and a flow control valve or valves 42 to control the delivery of the cleaning fluid to the distributor 38.

An actuator 44, which may be in the form of a manually operated trigger or lever, can be provided to activate the flow control system 36 and dispense the cleaning fluid to and through the distributor 38. For a normally closed valve assembly, the actuator 44 may be operatively coupled to the valve 42 such that pressing the actuator 44 will open the valve 42. The valve 42 may be an electrically actuated valve device such that an electrical switch 46 located between the valve 42 and power source 22 is selectively closed when the actuator 44 is pressed, thereby powering the valve 42 to move to an open position. While any of an assortment of different flow-controlling devices may be employed, it may be desirable that the valve 42 of FIG. 1 be an electromagnetic solenoid valve or a manual spool valve. The liquid pump 40 can also be electrically connected to and powered by the power source 22. In accord with the illustrated architecture, the pump 40 may be a centrifugal pump or a solenoid pump. It will also be understood that the pump 40 may be eliminated from the fluid delivery system 12 and, if desired, the flow control system 36 may be a gravity-fed system. For instance, one or more mechanically actuated or electrically actuated valves may be fluidly coupled with outlet ports of the fluid container 34 and, when opened, the one or more mechanically actuated or electrically actuated valves may allow fluid to flow under the force of gravity to the distributor 38.

With continued reference to FIG. 1, the fluid distributor 38 may include one or more distributor outlets 48 for ejecting the cleaning fluid onto the surface to be cleaned. The one or more distributor outlets 48 may be packaged within the extraction cleaner 10 system to deliver fluid directly onto the surface to be cleaned or indirectly by delivering fluid onto or through the agitator 26. The one or more distributor outlets 48 may take on any suitable structure, such as a nozzle or spray tip or a distributed arrangement of distributor outlets 48. As illustrated in FIG. 1, for example, the distributor outlet 48 includes multiple spray tips that dispense the cleaning fluid onto the surface to be cleaned. If desired, the cleaning tool 30 may optionally include an auxiliary distributor outlet (not shown) that is coupled with the fluid delivery system 12. While FIG. 1 may be considered a schematic illustration of an upright deep cleaner (UDC), select features from FIG. 1 may be adapted for incorporation into other extraction cleaner configurations, including portable deep cleaners (PDC) of the hand-held and pod style.

An optional fluid heater device 50 may be fluidly interposed between the fluid container 34 and the fluid distributor 38 to selectively heat the cleaning fluid prior to the liquid pump 40 delivering the cleaning fluid through the distributor outlets 48 to the surface to be cleaned. According to the example illustrated in FIG. 1, an in-line electronic heater 50 is located downstream from the fluid container 34 and upstream of the pump In yet another example, the cleaning fluid can be heated using exhaust air from a motor-cooling exhaust pathway for the suction source 18.

The fluid delivery system 12 of FIG. 1 may employ a single vessel or multiple vessels for storing and dispensing the cleaning fluid or the pre-mixed components of a cleaning fluid mixture. For example, a first fluid container 34 may store water and a second fluid container 52 may store a cleaning detergent or additive. By way of example, and not limitation, the first and second fluid containers 34, 52 may be defined by a supply tank and a collapsible bladder. In one configuration, the first fluid container 34 may be a bladder that is stored within the recovery container 20. Alternatively, a single fluid container may be fabricated with multiple internal chambers for storing a variety of different liquids. The cleaning fluid in either of the fluid containers 34, 52 can include, but is not limited to, water or a mixture made up of water and one or more treating agents. These treating agents may include, but are not limited to, detergents, odor eliminators, sanitizers, stain removers, odor removers, deodorizers, fragrances, or any combination thereof.

For fluid delivery system architectures that employ multiple fluid containers 34, 52, the flow control system 36 may be equipped with a mixing system 54 operable to control a composition of the cleaning fluid that is delivered to the surface through the distributor 38. The cleaning fluid composition may be determined by a controlled ratio of cleaning fluids mixed together by the mixing system 54. As shown in FIG. 1, the mixing system 54 is typified by a mixing manifold 56 that selectively receives fluid from one or both of the fluid containers 34, 52. A mixing valve 58 is fluidly coupled with an outlet port of the second fluid container 52. When the mixing valve 58 is opened, the cleaning fluid component from the second fluid container 52 will flow to the mixing manifold 56. The composition of the cleaning fluid that is delivered to the surface to be cleaned can be selected by controlling the valve flow characteristics—timing, frequency, and length—of the mixing valve 58.

In operation, the extraction cleaner 10 of FIG. 1 may be prepared for use by electrically connecting the extraction cleaner 10 to the power source 22 and by filling one or both fluid containers 34, 52 with a cleaning fluid or cleaning fluid components. Metered amounts of the cleaning fluid may be selectively delivered to a chosen surface to be cleaned via the fluid delivery system 12 by user-activation of the actuator 44. If desired, the extraction cleaner 10 may be concurrently moved back and forth over the chosen surface to be cleaned. The agitator 26 can simultaneously agitate the cleaning fluid into the chosen surface to be cleaned. During operation of the fluid recovery system 14, the extraction cleaner 10 draws in fluid and debris-laden working air through the suction nozzle 16 or the cleaning tool 30, depending on the position of the diverter assembly 32. The working air is pulled into the downstream recovery container 20 where the liquid and debris are substantially separated from the working air. The airstream then passes through the suction source 18 prior to being exhausted from the extraction cleaner 10. The recovery container 20 can be periodically emptied of collected fluid, dirt, and other debris. Additional details of extraction cleaners, including their constituent parts, architectures, and uses, are disclosed in U.S. Pat. Nos. 7,784,148, 9,560,948, 10,188,252, 10,588,476, and 10,624,515, all of which are incorporated herein by reference in their respective entireties and for all purposes.

Discussed below are wet-type extraction cleaner systems, methods, and devices with a removable pad disposed inside a dedicated compartment in fluid communication with the recovery pathway of the suction nozzle. In an example, a disposable and absorbent pad is removably inserted into a pad compartment, which is integrated into a liquid suction nozzle and defines a respective portion of the fluid recovery pathway of a battery powered handheld PDC, to absorb extracted fluid and debris. After use, the pad is readily removed from the nozzle and cleaned or disposed of such that a new/cleaned pad may be inserted into the PDC spray and suction nozzle. For at least some implementations, the removable pad can be used in place of or, if desired, in addition to a recovery tank.

Improvements in user convenience may be realized by allowing for easier collection and disposal of debris, liquid, and debris-entrained-liquid waste. Furthermore, by locating the removable pad in the working air flow of the recovery path, the user is enabled to move the nozzle with the pad back and forth over a chosen surface in a manner that is more consistent with current spot and stain cleaning behavior. Positioning the removable pad in the nozzle of the extraction cleaner at the upstream "intake" end of the recovery path also helps to reduce or eliminate the ingestion of liquids, dirt, and other debris into the internal plumbing of the cleaner device thereby substantially decreasing the need to regularly clean the cleaner device. Other attendant benefits may include enabling concurrent use of spraying, agitation, and pad absorption as well as the ability to make the stain recovery visible to the user. For at least some designs, the removable pad may be designed to include a disposable pouch or other fluid holding/delivery feature; in this way, the pad may serve fluid dispensing, separation, and disposal functions.

FIG. 2 presents a non-limiting example of an extraction cleaner 100 in the form of a battery powered, handheld portable deep cleaner. As shown, the extraction cleaner 100 is adapted to be handheld and portable in that it weighs less than 4.53 kg (10 lbs.) or, in at least some applications, between about 0.68 kg (1.5 lbs.) and about 2.04 kg (4.5 lbs.) and can be easily carried and operated by a single hand or both hands of an average adult human. The extraction cleaner 100 is assembled with a unitary and protective cleaner body 112 that has an integral carry handle 114 and a fluid suction source (e.g., a motor-fan vacuum or the suction source 18 of FIG. 1), a fluid pressure source (e.g., the liquid pump 40), and a power source (e.g., a battery pack or the power source 22) housed therein. Also mounted to the cleaner body 112 is a cleaning head 116 with a spray nozzle assembly 118 and a suction nozzle assembly 120, a recovery tank 122, and a removable battery container 124. To this end, the cleaner body 112 houses and carries the various functional systems of the extraction cleaner 100, including a fluid delivery system for storing and selectively dispensing a cleaning fluid (e.g., the fluid delivery system 12 of FIG. 1) and a fluid recovery system for collecting and storing spent cleaning fluid and debris from the surface to be cleaned (e.g., the fluid recovery system 14).

The fluid recovery system of FIG. 2 may be defined by, among other elements, a suction nozzle assembly 120 with a nozzle inlet 126 port that defines an upstream-most "intake" end of a working air path, and a suction source 128 that is downstream from and fluidly connected to the nozzle inlet 126 for generating a working air stream. The recovery system of FIG. 2 also contains a recovery tank 122 that is interposed between the suction source 128 and the nozzle inlet 126 for separating and collecting liquid and debris from the working airstream for later disposal. A downstream-most "exhaust" end of the working air path may be defined by one or more exhaust vents 130 in the cleaner body 112 through which air is ejected from the extraction cleaner 100. A thumb-activated suction power switch 110 may be located at a forward end of the carry handle 114 and can be pressed by a user to selectively activate and, pressed again, to selectively deactivate the suction source 128 for operation of the fluid recovery system. It is envisioned that the fluid recovery system of FIG. 2 may include any of the features and options described above with respect to the fluid recovery system 14 of FIG. 1 and any other commercially available componentry.

By way of comparison to the fluid recovery system, the fluid delivery system of FIG. 2 may be defined by, among other elements, a spray nozzle assembly 118 with a nozzle distributor port 136 that defines a downstream-most "ejection" end of a working liquid path, and a liquid reservoir, bottle, or tank 132 (collectively "liquid source") for storing and feeding metered amounts of a cleaning liquid to and through the distributor port 136. This cleaning liquid may contain, for example, a mixture of water, solvents, surfactants, emulsifiers, fragrances, preservatives, and/or other detergent agents and additives. An upstream-most "pressure supply" end of the working liquid path may be defined by a flow control system 134 for governing the flow of the cleaning liquid from the liquid source 132 to the distributor port 136. A finger-activated spray actuator switch 138 may be located underneath a gripping portion of the carry handle 114 and triggered by a user to selectively activate the flow control system 28 and dispense the cleaning liquid through the distributor port 136. It is envisioned that the fluid delivery system of FIG. 2 may include any of the features and options described above with respect to the fluid delivery system 12 of FIG. 1 and any other complementary componentry.

An agitator 140 may be mounted to the cleaner body 112, adjacent the nozzle inlet 126 port of the suction nozzle assembly 120, for agitating a dirty or stained surface so that the associated debris or liquid stain is more easily released and ingested into the extraction cleaner 100. As shown, the agitator 140 is a stationary brush assembly with a rectangular array of bristles 142 that projects downward at an oblique angle from the cleaner body 112. The suction nozzle assembly 120, onto which are mounted these bristles 142, is packaged at a forward-most end 32 of the cleaner body 112, while the removable battery container 124 is provided at a rearward-most end 34 of the body 112 opposite that of the suction nozzle assembly 120. The recovery tank 122 is removably inserted into a complementary slot in the cleaner body 112 behind the agitator bristles 142 and below the liquid source 132 and suction source 128.

Figure 3:
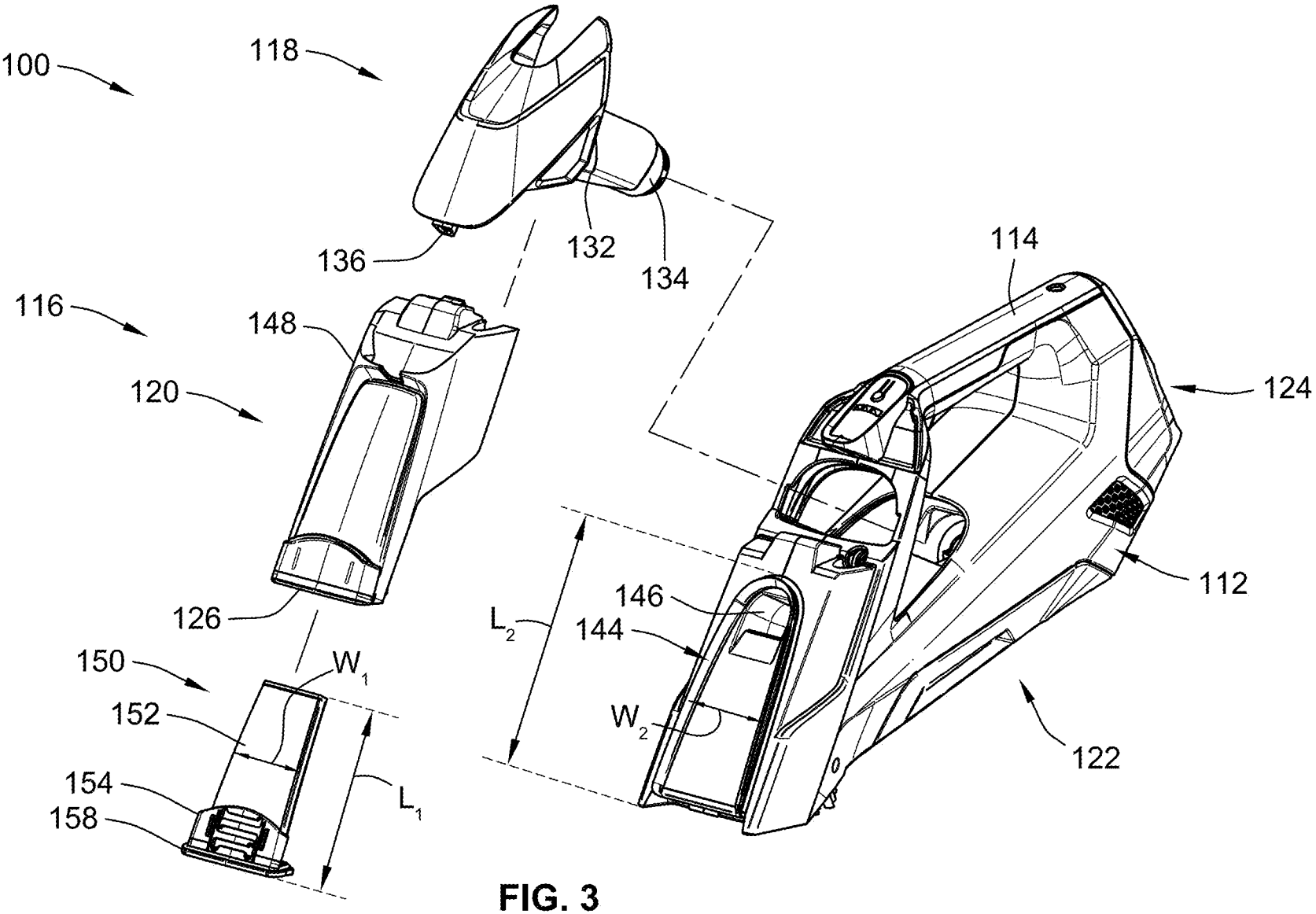
FIG. 3 is a partially exploded, top perspective view of the representative wet-extraction PDC of FIG. 2, showing removal of the representative absorbent pad from the recovery pathway in the nozzle head.
Figure 4:
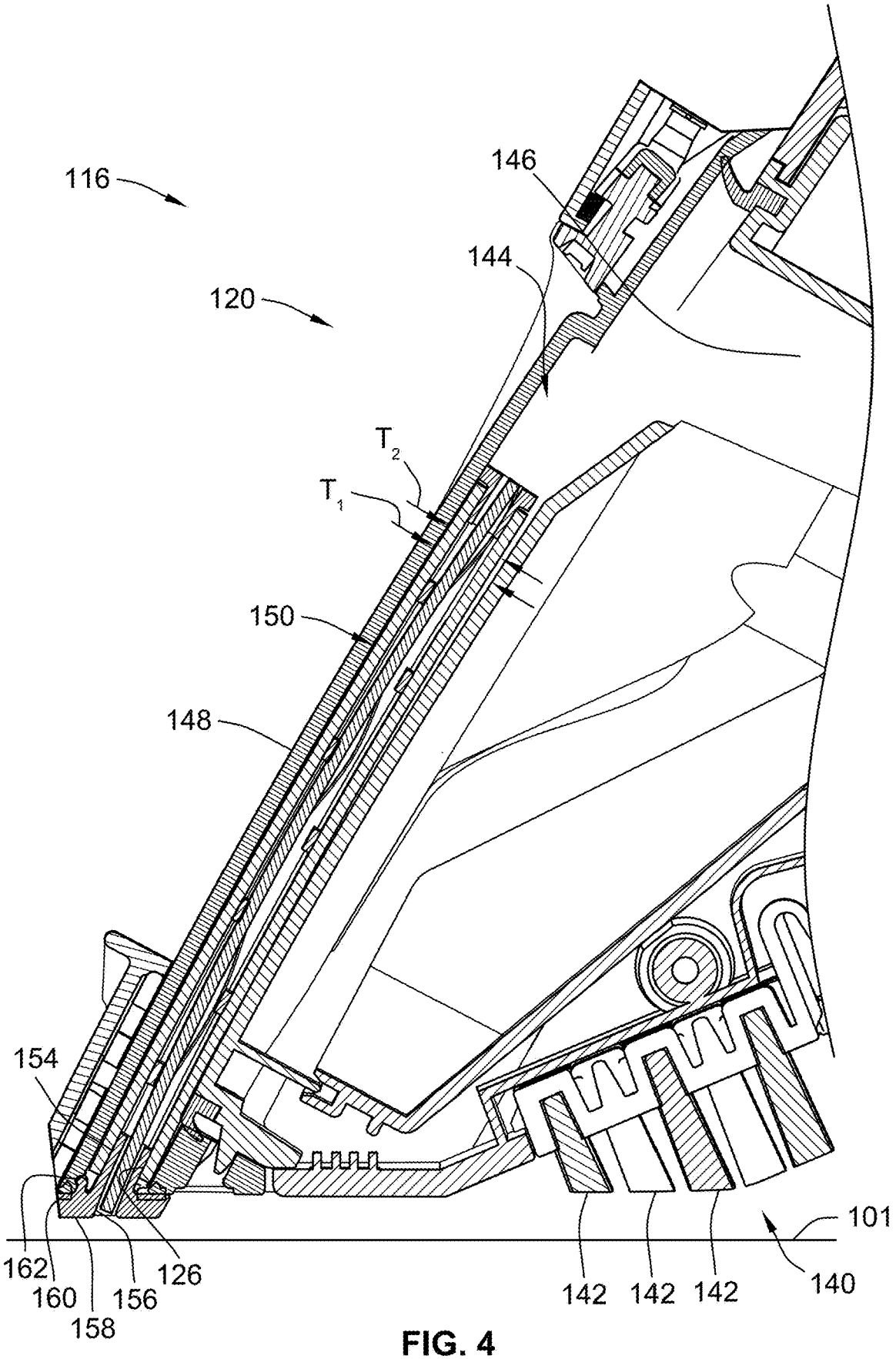
FIG. 4 is an enlarged, side view of the nozzle head of FIG. 2 taken in cross-section along a vertically oriented longitudinal plane to show the absorbent pad disposed in and substantially filling a portion of the PDC's recovery pathway.

Integrated into the suction nozzle assembly 120 of the cleaning head 116 is a pad compartment 144 that stores therein a removable absorbent pad 150 assembly (FIG. 3). The pad compartment 144 of FIGS. 2-4 is located within and, as shown, at least partially defines the working airflow pathway of the fluid recovery system in the extraction cleaner 100. In accord with the illustrated example, the pad compartment 144 is located at the forward-most end of the cleaner body 112, positioned underneath the spray nozzle assembly 118 and above the agitator 140. The pad compartment 144 fluidly connects the upstream-most end of the fluid recovery pathway, namely the nozzle inlet 126, with the downstream-most end of the recovery pathway, namely the recovery tank 122. In particular, an opening in the upstream (first) end of the pad compartment 144 defines the nozzle inlet 126, whereas an opening in the downstream (second) end of the pad compartment 144 fluidly connects to the recovery tank 122 by an intake runner 146 segment of the fluid recovery pathway. The pad compartment 144 may be substantially fluidly sealed (except at its open ends) such that the working air path of the fluid recovery system passes through the compartment 144 and the removable pad 150 contained therein. As best seen in FIG. 4, interfacing interior contact surfaces of the pad compartment 144 may be substantially coextensive with juxtaposed outer contact surfaces of the absorbent pad 150 such that the pad 150 sits substantially flush against the interior surfaces of the compartment 144.

The cleaning head 116 of FIGS. 2-4 may incorporate a pad compartment case 148 that extends over the pad compartment 144 and covers the removable pad 150. In the illustrated extraction cleaner 100 design, the compartment case 148 is a single-piece structure that is optionally formed from a substantially clear polymeric material such that the absorbent removable pad 150 is visible through the case 148 while in the pad compartment 144. In FIG. 3, the compartment case 148 is shown as being removable from the cleaning head 116 for maintenance or cleaning of the case 148 and the extraction cleaner 100. Alternatively, the compartment case 148 may be fixedly attached to the suction nozzle assembly, e.g., via threaded fastener or snap-lock engagement. As shown, the pad compartment case 148 defines the forward-most face of the suction nozzle assembly 120 and the extraction cleaner 100. Moreover, a bottom end of the compartment case 148 may define a forward periphery of the nozzle inlet 126 port. With this design, the nozzle inlet 126 may be angled with respect to the cleaner body 112 (e.g., approximately 30 degrees, as illustrated in FIG. 2) such that, when in a use position, shown in FIG. 4, the handheld extraction cleaner 100 may be held at an angle while the nozzle inlet 126 is generally horizontal to a chosen surface 101 to be cleaned.

Figure 9:
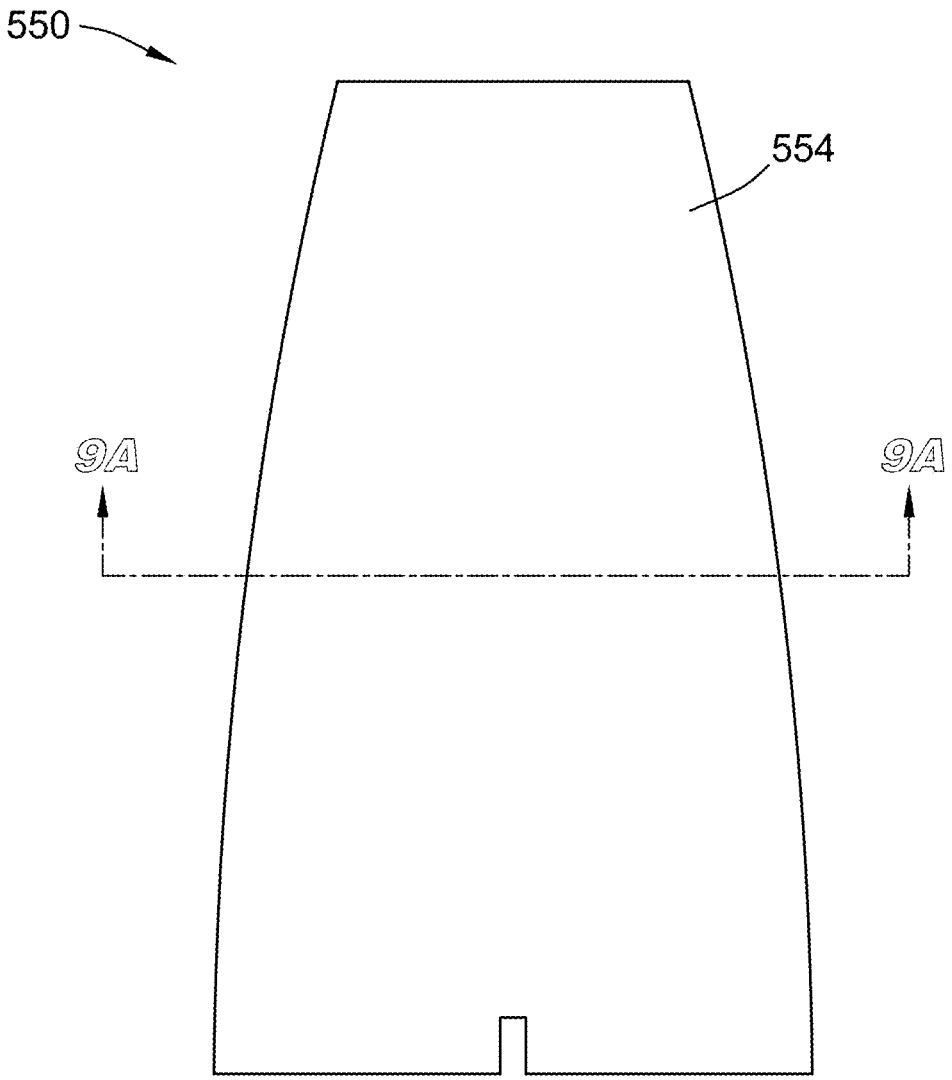
FIGS. 9 and 9A are a top plan view and a cross-sectional view, respectively, of a representative removable absorbent pad for a recovery pathway of an extraction cleaner system in accord with aspects of this disclosure.
Figure 10:
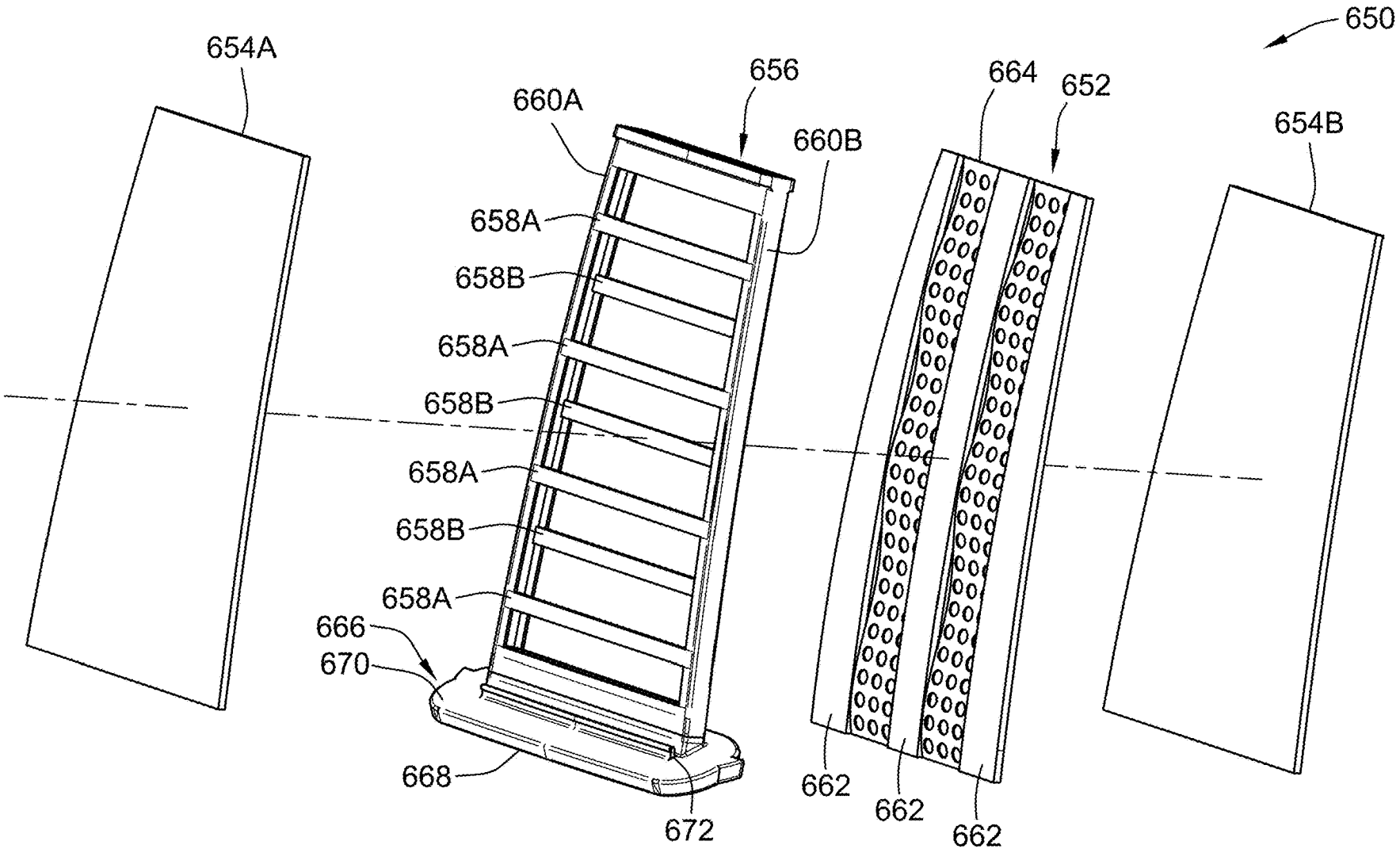
FIG. 10 is a partially exploded, front perspective view of another representative removable absorbent pad for a recovery pathway of an extraction cleaner system in accord with aspects of this disclosure.

To collect spent cleaning solution, dust, stains and other debris drawn into the extraction cleaner 100, an absorbent pad 150 assembly is inserted into the interior chamber of the pad compartment 144. The absorbent pad 150 may be fabricated as a unitary, one-piece structure from a permeable yet absorbent and compliant material, as described below with respect to absorbent pads 350 and 450 of FIGS. 7 and 8, respectively. Alternatively, the absorbent pad 150 may be fabricated as a unitary multipiece construction, such as a jacketed absorbent pad 550 unit, as shown in FIG. 9 or an exoskeletal absorbent pad 650 assembly, as shown in FIG. 10. Generally speaking, the absorbent pad 150 assembly has a pad body 152 that is sufficiently permeable to allow the working air flow of the recovery pathway to flow through the pad 150 and, thus, through the pad compartment 144. However, the pad body 152 is sufficiently absorbent to trap most or all of the recovered cleaning solution expelled through the nozzle distributor port 136 and the staining liquids, dust, and other debris vacuumed in through the suction nozzle inlet 126. Insertion and removal of the absorbent pad 150 into and from the pad compartment 144 may be achieved by a user manually sliding the pad 150 through the nozzle inlet 126.

With collective reference to FIGS. 3 and 4, a longitudinal (top-to-bottom) pad length $L_1$ of the absorbent pad 150 may be less than a longitudinal (top-to-bottom) compartment length $L_2$ of the pad compartment 144, e.g., to ensure that the pad 150 does not cover or occlude an opening to the intake runner 146. However, it may be desirable that the length $L_1$ of the absorbent pad 150 be at least about 60% or, as shown, approximately 65-70% the length $L_2$ of the pad compartment 144, e.g., to ensure the pad 150 fills a majority of the compartment 144. In contrast, a transverse (left-to-right) pad width $W_1$ (FIG. 3) and a normal (front-to-back) pad thickness $T_1$ (FIG. 4) of the absorbent pad 150, which is orthogonal to the pad length $L_1$ and width $W_1$, may be approximately equal to a transverse (left-to-right) compartment width $W_2$ and a normal (front-to-back) compartment depth $T_2$, respectively, of the pad compartment 144. This arrangement may help ensure that the outer lateral perimeter of the pad 150 adjoins and, if desired, presses against the inner perimeter of the compartment 144 such that the pad 150 fills the fluid recovery pathway immediately downstream from the nozzle inlet 126.

It is envisioned that the absorbent pad 150 may take on both regular and irregular geometric shapes with uniform and non-uniform dimensions. The absorbent pad 350 of FIG. 7, for example, has a rectangular plan-view profile in which the length, width, and thickness of the absorbent pad 350 are substantially constant over the full extent of the pad 350. Conversely, the absorbent pad 550 of FIG. 9 has a symmetrical yet oblong irregular plan-view geometry in which the width (left-to-right) of the pad 550 varies over its length (top-to-bottom). As another non-limiting example, the absorbent pad 650 assembly of FIG. 10 has an oblong irregular plan-view geometry in which the thickness (front-to-back) of the pad 650 varies over its length (top-to-bottom). As noted above, it is within the scope of this disclosure to mix-and-match features from one cleaner and/or pad configuration with any of the other disclosed cleaner and/or pad configurations.

For operation of the handheld PDC-type extraction cleaner 100, a user manually inserts the absorbent pad 150—in a telescoping manner—into the pad compartment 144 by sliding the pad 150 along a substantially rectilinear path through the nozzle inlet 126. The absorbent pad 150 may be temporarily secured within the suction nozzle assembly 120 by any suitable type of fit known in the art, such as via a press fit, transition fit, snap tab, spring-loaded tab, retaining door, etc. In the example of FIGS. 2-4, the absorbent pad 150 assembly includes a nozzle cap 154 (FIG. 3) that is mounted to a distal (bottom) end of the pad body 152 and defines a pad port 156 (FIG. 4) that draws the cleaning solution, dirt, and other debris therethrough for absorption into the pad 150. Projecting transversely outward from a distal tip of the nozzle cap 154 is an annular flange 158 that bears a soft seal 160 and flexible seal ring 162 (FIG. 4). When the absorbent pad 150 assembly is inserted into the pad compartment 144, the soft seal 160, which is mounted on an upper face of the flange 158, sealingly seats against an opposing bottom face of the nozzle inlet 126 port. At the same time, the flexible seal ring 162 press-fits into the nozzle inlet 126 and thereby mechanically secures the pad 150 to the suction nozzle assembly 120. In this manner, the pad port 156 is generally aligned with the nozzle inlet port 126 such that, during a cleaning process, a mixture of air and liquid and/or debris is drawn through the nozzle inlet port 126, into the pad port 156, and into the pad body 152. The pad body 152 captures the extracted liquid and/or debris while the separated air exits the pad body 152 and enters the intake runner 146, where it then travels through airflow system and is exhausted through the exhaust vents 130 in the cleaner body 112.

Figure 5:
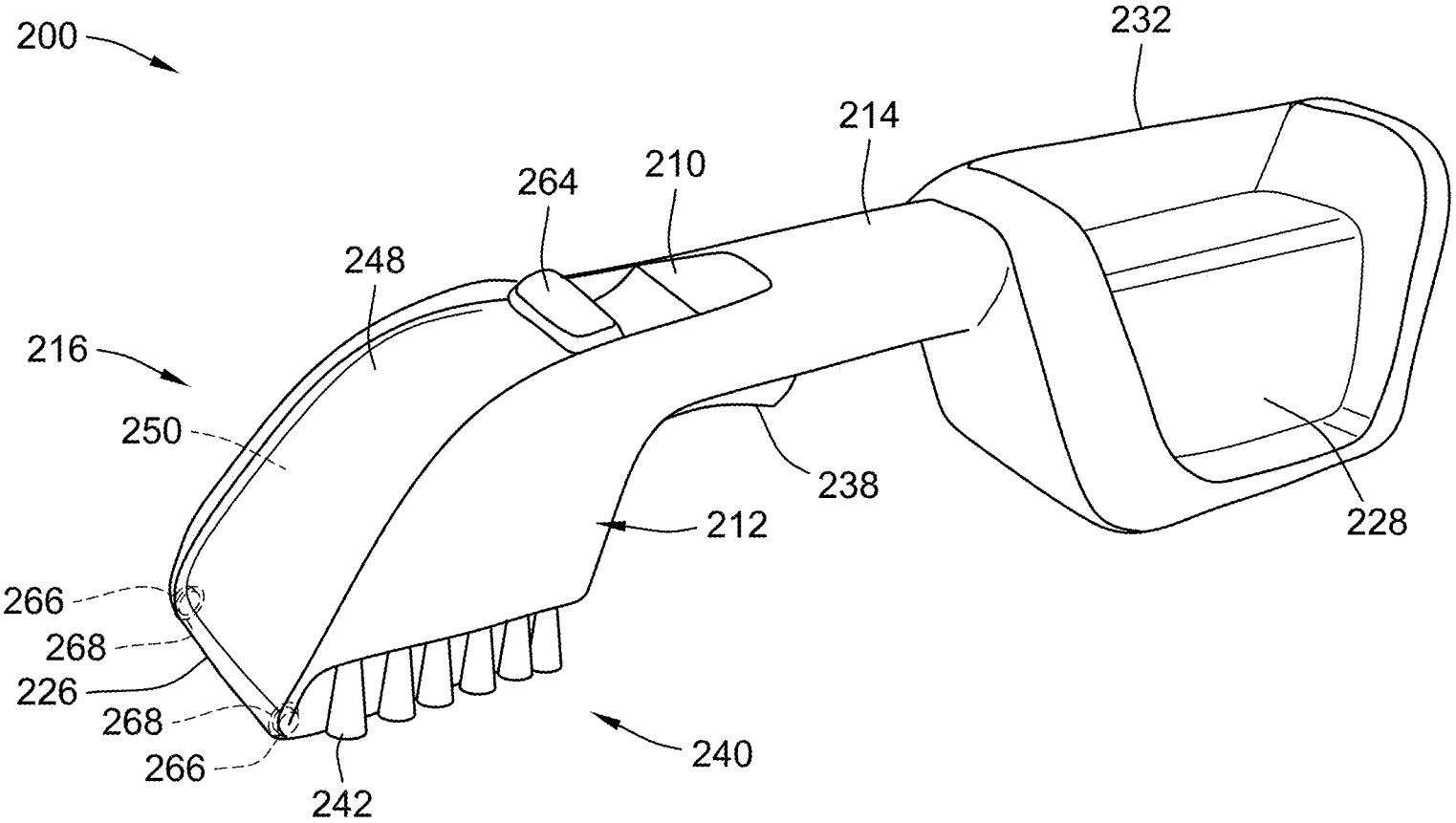
FIG. 5 is an enlarged, side perspective view of a representative handheld wet-extraction type portable deep cleaner sans a recovery tank and with a removable absorbent pad in accord with aspects of this disclosure.

With reference now to FIG. 5, another example of an extraction cleaner 200 is provided. in the extraction cleaner 200 is shown in the form of a battery powered, handheld PDC without a recovery tank such that an absorbent pad 250 within the recovery pathway absorbs substantially all stains/liquids/dirt/debris pulled into the extraction cleaner 200. Similar to some of the other vacuum-based cleaner architectures discussed herein, the extraction cleaner 200 includes a protective outer housing or main body 212 with an integral carry handle 214. At a forward end of the extraction cleaner 200 is a cleaning head 216 with a built-in sprayer, e.g., for spray treating a cleaning solution or mixture onto stains. In FIG. 5, a distributor port of the built-in sprayer is located on a bottom face of the cleaning head 216, behind the nozzle inlet 226 port and at least partially circumscribed by the bristles 242 of an agitator 240. It is also contemplated that a nozzle distributor port 236 may be positioned on the front face of the cleaning head 216, above the pad compartment 244 and forward of the handle 214, as shown in FIGS. 6A-6D.

With reference now to FIGS. 6A-6D, to operate the fluid recovery system of the extraction cleaning 200, a finger-activated pump trigger 210 located on the carry handle 214 is manually operated by a user to start/stop an electric pump 228 packaged at the rear of the main body 212, e.g., inside a refillable cleaning solution tank 232. Alternatively, a user may effect use of the fluid delivery system of the extraction cleaner 200 via manual operation of a finger-activated spray trigger 238, e.g., to actuate an electric spray pump or manually driven piston pump housed inside the main body 212. This simplified design may help to reduce upfront costs while improving the operating experience of end users. Moreover, by eliminating the recovery tank, the extraction cleaner 200 of FIG. 5 may be lighter and smaller than the extraction cleaner 100 of FIG. 2.

In addition to eliminating the recovery tank, disclosed vacuum-based cleaner devices may replace fixedly-mounted pad compartment cases with movably-mounted access covers that allow for insertion and removal of absorbent pads from the fluid recovery pathway of the cleaner devices. The extraction cleaner 200 of FIG. 5, for example, is equipped with a pad compartment door 248 that is pivotably mounted to the cleaning head 216 to cover and secure the removable pad 250 in place within the pad compartment 244. The pad compartment door 248 may optionally come in the form of a substantially transparent yet rigid lens through which the pad 250 can be seen while the extraction cleaner 200 is in use. A thumb slot 264 integrated into the top end of the compartment door 248 may be manually operated by the user to open and close the compartment door 248 for access to and closing off the pad compartment 244. The absorbent (and optionally disposable) pad 250 is placed within the pad compartment 244 inside the suction nozzle assembly 220 to absorb dirt/debris/stains/liquids/etc. extracted from the surface to be cleaned.

The pad compartment door 248 of FIG. 5 may be pivotably mounted to the main body 212 of the extraction cleaner 200 via any appropriate mechanism, including radial bearings, pivot pin couplings, swivel joints, rivet joints, etc. According to the illustrated example, the pad compartment door 248 is fabricated with at least one or, as shown, a pair of (first and second) pivot pins 266 that project transversely from opposing (first and second) sides of the compartment door 248 adjacent a longitudinal (bottom) end thereof. The suction nozzle assembly 220 includes a corresponding number of (first and second) pin slots 268, each of which receives a respective one of the pivot pins 266 therein to pivotably mount the pad compartment door 248 to the suction nozzle assembly 220. With this arrangement, the compartment door 248 is moveable between an open position (FIG. 6A), in which the pad compartment 244 is accessible by a user, and a closed position (FIG. 6B), in which the pad compartment 244 is not accessible by a user.

Figure 6A:
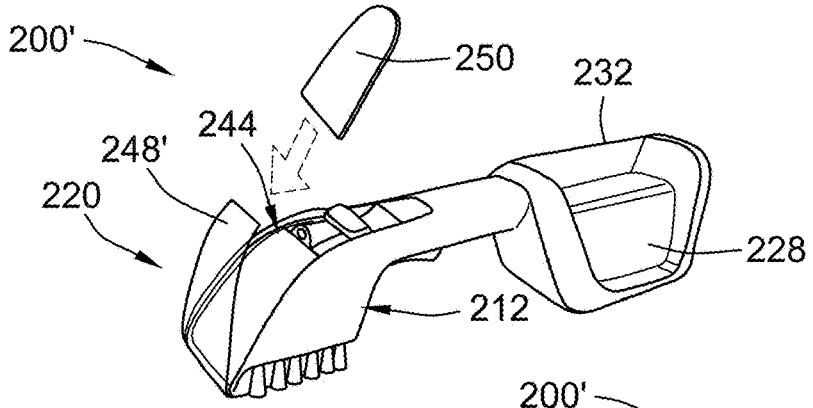
FIGS. 6A-6D are side perspective views of a representative PDC similar to the one shown in FIG. 5, showing a user operating sequence for the representative PDC and removable absorbent pad.
Figure 6B:
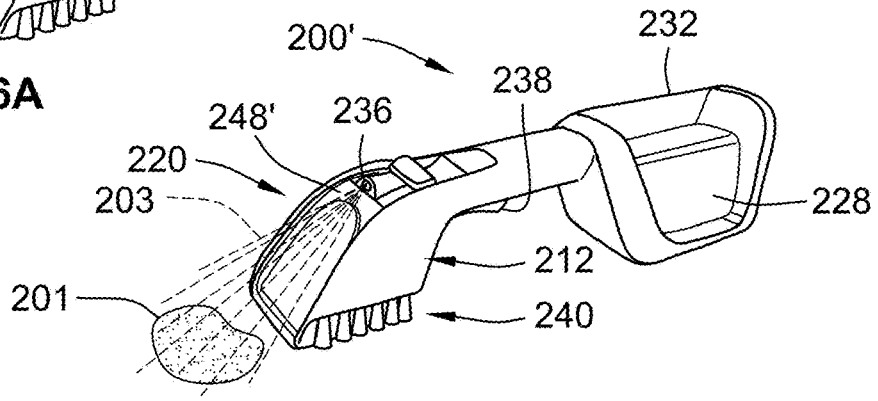

FIGS. 6A-6D may be indicative of a workflow diagram illustrating a representative use sequence for a wet-extraction, PDC-type cleaner 200' that may be similar in construction to the extraction cleaner 200 of FIG. 5. In FIG. 6A, for example, the pivotable pad compartment door 248' is shown pitched forward (e.g., rotated in a counterclockwise direction) to an open position in order to provide the user with access to the pad compartment 244. When the pad compartment door 248' is open, the user may insert a disposable or reusable pad 250 into the pad compartment 244. If not already present, liquid cleaning solution may be added to the refillable cleaning solution tank 232. After ensuring the refillable cleaning solution tank 232 is filled with cleaning solution 203 and the pad compartment 244 contains the removable pad 250, as shown in FIG. 6A, the pad compartment door 248' is pivoted aftward (e.g., rotated in a clockwise direction) to a closed position in which the pad compartment door 248' covers the pad 250 and physically retains it within the pad compartment 244, as shown in FIG. 6B. The user then positions the extraction cleaner 200' adjacent a stained surface 201 to be cleaned and depresses the spray trigger 238 to eject the cleaning solution 203 onto the stained surface 201. The user may contemporaneously scrub the stained surface 201 with the agitator bristles 242.

Figure 6C:
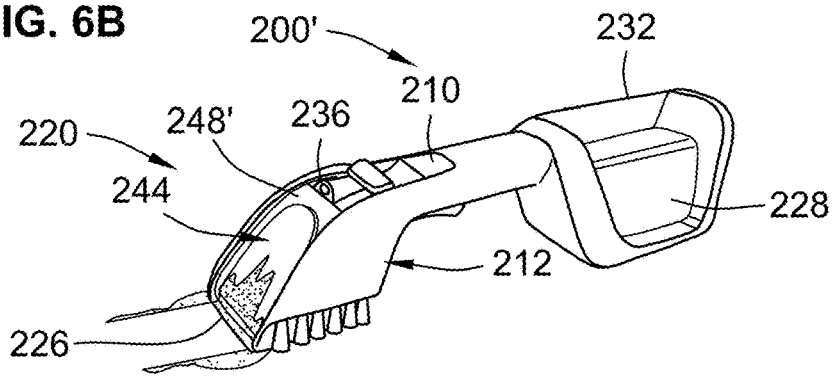
Figure 6D:
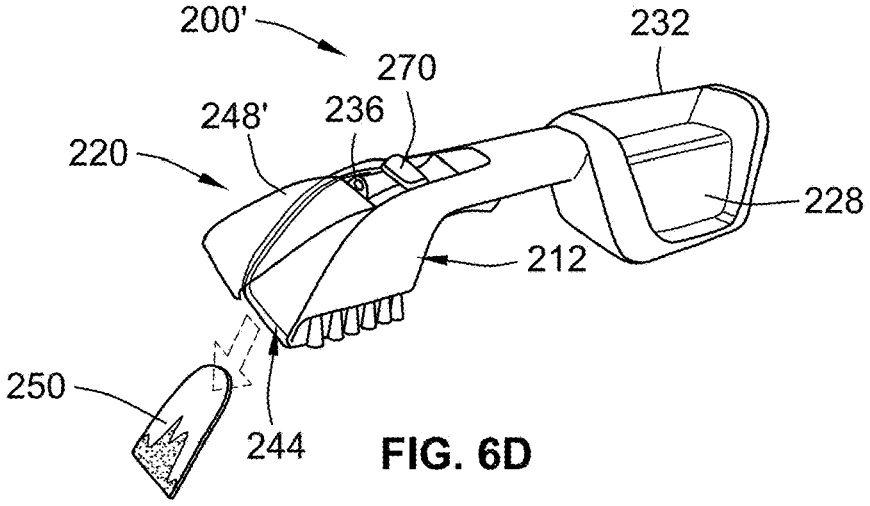

After spraying and scrubbing the stained surface 201, the user depresses the pump trigger 210 to vacuum the spent cleaning solution 203 and stained liquid and other debris removed from the surface 201 through the nozzle inlet 226 port and into the pad compartment 244, as shown in FIG. 6C. The extracted liquid and entrained debris are concomitantly absorbed by the removable pad 250 inside the compartment 244. The user is able to view the absorbent pad 250 through the fully/partially transparent compartment door 248 to confirm that it has, in fact, been soiled with the extracted liquid, dirt, and entrained debris. Once the stained surface 201 is cleaned, the user may press a pad ejection trigger 270 that is operatively connected to a spring-biased release tab (not shown) adjacent the base of the pad compartment door 248'. The pad compartment door 248' may be spring-biased in a rearward pitch motion to another open position (FIG. 6D). When the pad compartment door 248' is pivoted open, the soiled pad 250 can then be ejected from the pad compartment 244 by hand, ejection mechanism, or under the force of gravity and, for disposable configurations, readily discarded. Additional options for inserting and removing a pad from an extraction cleaner include the use of a nozzle lens that is removable (e.g., snap-fit connection), or a nozzle lens that is moveable relative to the body between open and closed positions (e.g., sliding and hinged connections). It is also contemplated that the pad 250 may be ejected through the nozzle inlet 226 (e.g., by an injection mechanism that pushes the pad 250 out or by a user pulling the pad assembly out through a nozzle inlet, such as through the nozzle inlet 226 in FIG. 5).

Figure 7:
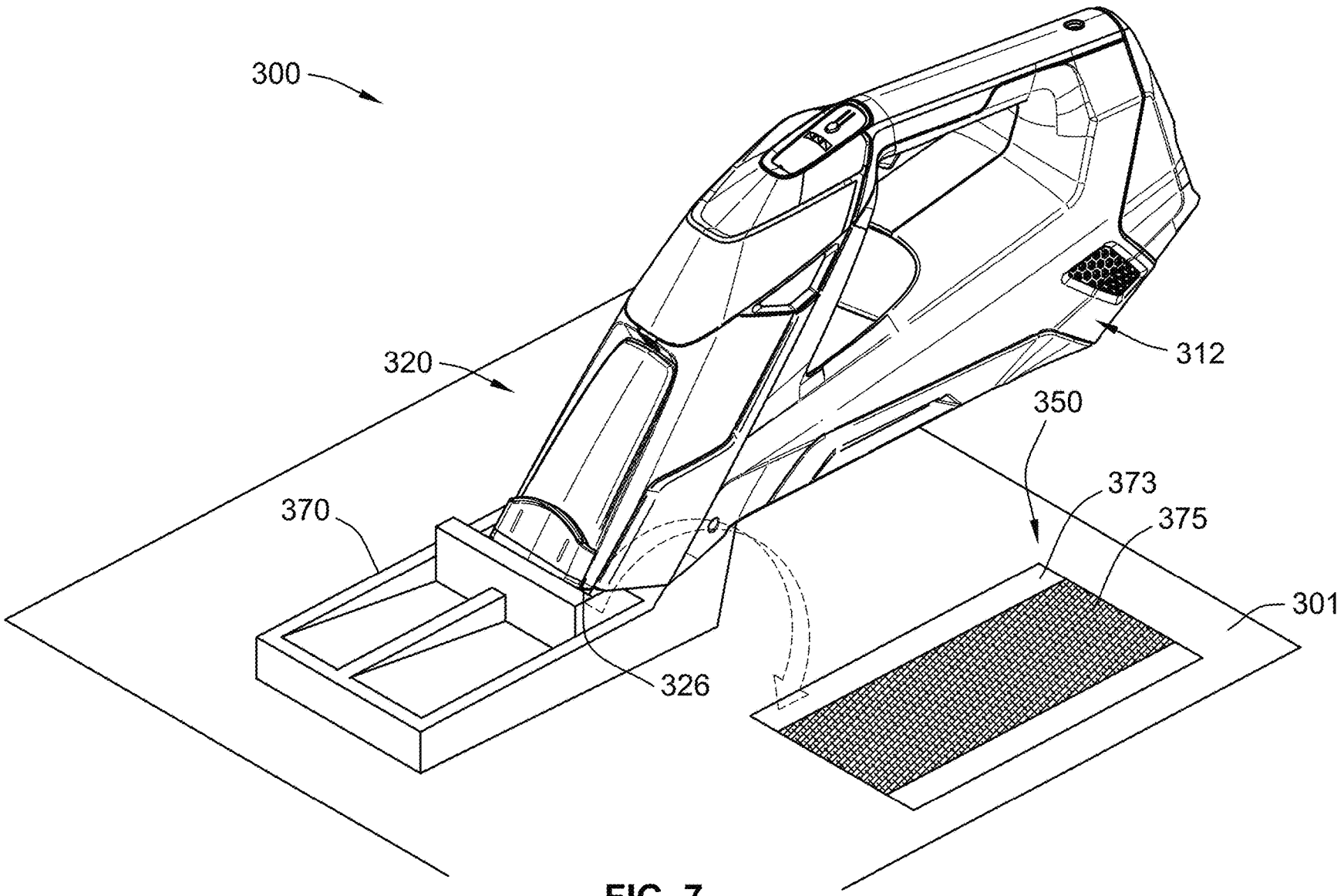
FIG. 7 is an enlarged, top perspective view of a representative handheld wet-extraction type portable deep cleaner with a pad-adapting nozzle attachment and a disposable absorbent pad in accord with aspects of this disclosure.

FIG. 7 illustrates another representative extraction cleaner 300 configuration in the form of a battery powered, handheld PDC that cooperatively cleans with an externally located extraction-boosting spot cleaning pad 350. The extraction cleaner 300 of FIG. 7 may be similar in construction and operation to the extraction cleaner 100 of FIG. 2 and, thus, may incorporate any of the features and options associated therewith. In this non-limiting example, however, the extraction cleaner 300 does not employ an integral pad compartment within which a removable absorbent pad is stowed. Rather, the extraction cleaner 300 is retrofit with a pad-adapting nozzle accessory or attachment 370 that securely mounts onto a suction nozzle assembly 320 and over a nozzle inlet 326. The nozzle attachment 370 fluidly couples to the nozzle inlet 326 port and nests the externally located spot cleaning pad 350 therein. The nozzle attachment 370 is a fluid extending and expanding tool that elongates the port and increases the suction size of the nozzle inlet 326 of the port, e.g., to cover and conceal the entire pad 350.

With reference again to FIG. 7, the absorbent spot cleaning pad 350 is laid flat onto a dirty or soiled surface 301 such that the pad 350 substantially covers a stained/dirtied section of the surface 301. A bottom face of the pad-adapting nozzle attachment 370, which may be equal to or greater in surface area than the top face of the pad 350, is seated on and pressed against the spot cleaning pad 350. This helps to ensure that the pad 350 remains static on the surface 301 while the extraction cleaner 300 applies suction air flow on the top face of the pad 350 to pull in spent cleaning solution, debris, etc. It may be desirable that the nozzle attachment 370 is a temporary accessory that is removable from a main body 312 of the extraction cleaner 300, e.g., for cleaning, replacement, or mating of another interchangeable vacuum accessory. To provide a fluid-sealing mating of the attachment 370 with the pad 350, an interface area on the bottom face of the attachment 370 is substantially coextensive with a contact area on the top face of the pad 350. The pad-adapting nozzle attachment 370 of FIG. 7 may include multiple rows and/or columns of ribs (not visible) that press down onto the pad 350 while allowing suction air flow to pass through pad 350 and accessory 370. The spot cleaning pad 350 of FIG. 7 may be a multilayer structure with a liquid-wicking base layer 373 that supports a liquid-trapping absorbent layer 375 thereon.

Figure 8:
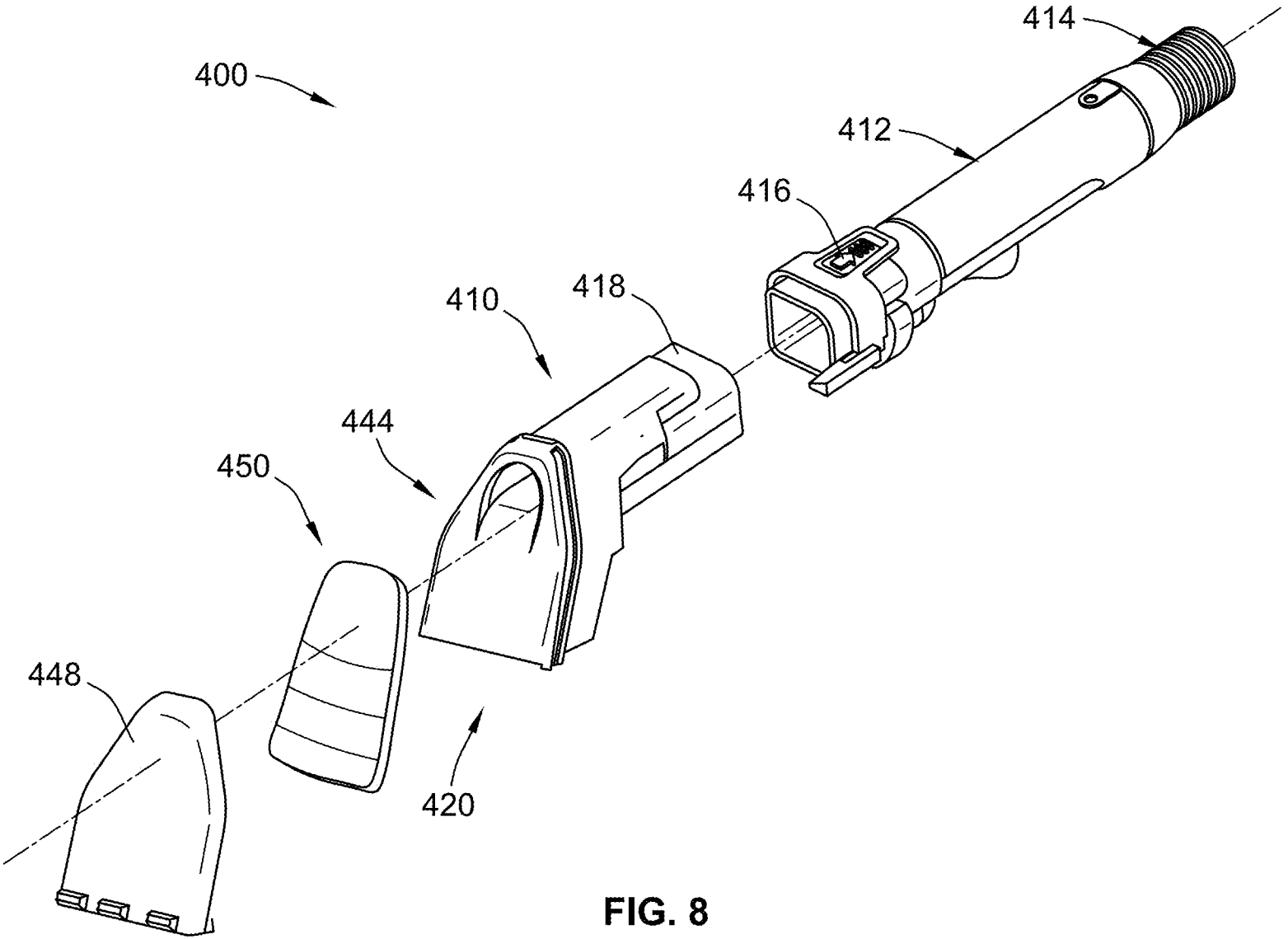
FIG. 8 is a partially exploded, top perspective view of a representative hand tool for an upright or portable extraction cleaner with a removable absorbent pad in accord with aspects of this disclosure.

With reference now to FIG. 8, an accessory tool assembly 400 is shown. The accessory tool assembly 400 may be mated with a complementary extraction cleaner, such as an upright or portable deep cleaner system. By way of example, and not limitation, the accessory tool assembly 400 includes a cleaning tool 410 that can be selectively fluidly connected to an accessory wand 412. The accessory wand 412 fluidly couples to the extraction cleaner system (e.g., extraction cleaner 10 of FIG. 1) via a mating accessory hose 414, as shown. A self-locking sliding coupler 416 receives a complementary interface segment 418 of the cleaning tool 410, thereby coupling the cleaning tool 410 to the accessory wand 412. Depending on the design of the coupler, manually rotating and/or sliding the coupler 416 in a predefined direction (e.g., counterclockwise or to the left in FIG. 8) will release the interface segment 418 and, thus, allow for removal of the cleaning tool 410 from the accessory wand 412.

In the example of FIG. 8, distal ends of the fluid delivery pathway and the fluid recovery pathway extend through the accessory wand 412 and the cleaning tool 410. A suction nozzle assembly 420 at a distal end of the cleaning tool 410 defines a pad compartment 444 for removably storing a removable, absorbent pad 450 such that the absorbent pad 450 is located within the fluid recovery pathway. The suction nozzle assembly 420 of FIG. 8 may incorporate a pad compartment case 448 that extends over the pad compartment 444 and covers the removable, absorbent pad 450. Similar to the compartment case 148 of FIG. 2, the compartment case 448 of FIG. 8 may be a single-piece structure that is formed from a substantially clear material and is coupled to the suction nozzle assembly 420. However, it will also be understood that the compartment case 448 may take on multipiece configurations and, optionally, may be fabricated from opaque materials. The compartment case 448 may take on a "nozzle lens" configuration that is removably attached to the cleaning tool 410. With this arrangement, the compartment case 448 is selectively removed by a user from the cleaning tool 410 to allow for insertion of the absorbent pad 450 into the pad compartment 444. Once the absorbent pad 450 is properly seated inside the pad compartment 444, the compartment case 448 is reattached to the cleaning tool 410 to more fully secure the absorbent pad 450 inside the pad compartment 444. It is also within the scope of this disclosure that the compartment case 448 be slidably, pivotably, permanently, or integrally attached to the cleaning tool 410.

Figure 9A:
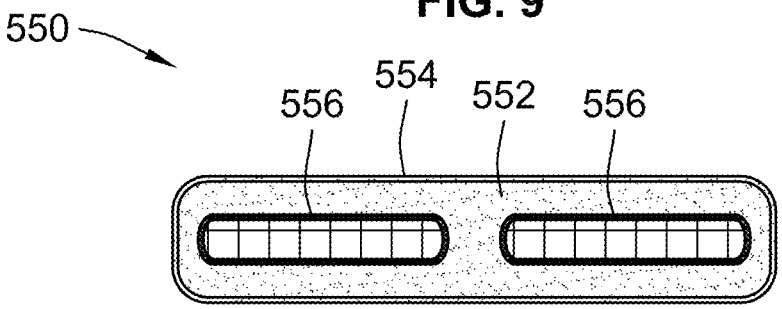

With reference now to FIGS. 9 and 9A, an example of a removable, absorbent pad in the form of a jacketed absorbent pad 550 is shown. As noted above, this jacketed absorbent pad 550 is shaped and sized to fit within a complementary compartment inside a nozzle portion of an extraction cleaner, such as pad compartment 144 of suction nozzle assembly 120 of FIG. 2. To this end, the absorbent pad 550 is designed to fill a discrete segment of the fluid recovery pathway to capture liquid and debris while allowing the working air stream to pass through the absorbent pad 550. In the illustrated example, the absorbent pad 550 includes a permeable and moisture-absorbing inner pad body 552 (FIG. 9A) that is surrounded by a non-permeable outer layer or jacket 554. It may be desirable that the outer jacket 554 does not cover the opposing (top and bottom) longitudinal ends of the pad body 552.

The pad body 552 may be an elongated and symmetrical structure that defines one or more airflow channels 556 that extend longitudinally through the body 552 (e.g., from top to bottom in FIG. 9). These one or more air flow channels 556 allow a sufficient volume and flow rate of air to pass through the pad 550 in order to recover liquid and debris without a marked restriction on the working air stream in the recovery pathway. The outer jacket 554 may be translucent or substantially transparent to allow recovered stains trapped in the pad body 552 to be readily visible. Alternatively, the jacket 554 may be substantially non-permeable to both gases and liquids to provide a circumferential barrier that controls the flow of working air through the absorbent pad 550. Conversely, the inner pad body 552 may be a hydrophilic and/or wicking material that draws in, captures, and retains a sufficient amount of liquid (e.g., at least 1-2 ounces) needed to effectively clean a spot or stain.

With reference now to FIG. 10, another example of a removable, absorbent pad, this time in the form of an exoskeletal absorbent pad assembly 650 is shown. As noted above, it is envisioned that the exoskeletal absorbent pad assembly 650 of FIG. 10 may incorporate any of the options and alternatives described above with respect to the absorbent pads 150, 250, 350, 450, and 550, and vice versa. The absorbent pad assembly 650 may include a rigid outer frame (or "exoskeleton") 656 that at least partially encases and structurally buttresses a compressible internal pad body 652. As shown, the rigid outer frame 656 has a ladder-type construction with a series of mutually parallel front cross-rails (or "rungs") 658A that are spaced longitudinally from each other and interleaved with a series of mutually parallel rear cross-rails (or "rungs") 658B. Opposing ends of each horizontally oriented front and rear cross-rail 658A, 658B are integral with or otherwise attached to vertically oriented, non-parallel siderails 660A and 660B. Top and bottom faces of the rigid outer frame 656 may be formed with fluid ports through which flows the working air stream of the recovery pathway.

Similar to the jacketed absorbent pad 550 of FIG. 9, the exoskeletal absorbent pad assembly 650 of FIG. 10 is fabricated with a flow-controlling non-permeable shell. The exoskeletal absorbent pad assembly 650 includes opposing front (first) and back (second) non-permeable plates 654A and 654B that are mounted to opposing front (first) and back (second) sides, respectively, of the rigid outer frame 656 to cover opposing faces of the pad body 652. The pad body 652 may include one or more elongated liquid-absorbent strips 662 that extend longitudinally along and are formed on or fixedly mounted to a permeable weave insert 664. For multistrip configurations, the liquid-absorbent strips 662 may be mutually parallel with and spaced laterally from each other. The permeable weave insert 664 may be a hole-filled substrate formed from a substantially rigid polymeric material.

With further reference to FIG. 10, the absorbent pad assembly 650 also includes a nozzle cap 666 that is fixed to a distal (bottom) end of the rigid outer frame 656 and extends across a distal (bottom) end of the pad body 652. The nozzle cap 666 defines a port (e.g., port 156 of FIG. 4) that draws cleaning solution, dirt, and other debris for absorption into the pad 650. Projecting transversely outward from the nozzle cap 666 is an annular flange 668 that bears a soft seal 670 and flexible seal tabs 672. When the absorbent pad assembly 650 is inserted into a complementary compartment, the soft seal 670 sealingly seats against an opposing bottom face of a nozzle inlet port of an extraction cleaner such as those described herein. At the same time, the flexible seal tabs 672 press-fit into the nozzle inlet and thereby mechanically secure the pad 650 assembly to the suction nozzle assembly.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

Additional features may be reflected in the following clauses:

Clause 1: An extraction cleaner system includes a cleaner housing with a fluid delivery pathway and a fluid recovery pathway. A suction source is disposed within the cleaner housing and fluidly connected to the fluid recovery pathway. The suction source is configured to create a fluid pressure vacuum. A liquid source is carried by the cleaner housing and fluidly connected to the fluid delivery pathway. The liquid source is configured to contain and dispense a liquid. A suction nozzle is fluidly connected to the fluid recovery pathway upstream from the suction source and is configured to draw therethrough the liquid dispensed from the liquid source. The suction nozzle defines therein a pad compartment located within the fluid recovery pathway. An absorbent pad is removably mounted inside the pad compartment.

Clause 2: The suction nozzle includes a compartment door that is disposed over the pad compartment and covers the absorbent pad.

Clause 3: The compartment door includes first and second pivot pins that project transversely from first and second sides, respectively, of the compartment door adjacent a longitudinal end thereof. The suction nozzle includes first and second pin slots that receive therein the first and second pivot pins, respectively, to thereby pivotably mount the compartment door to the suction nozzle.

Clause 4: The extraction cleaner system further includes an actuator trigger connected to the compartment door and manually operable to release the compartment door and thereby allow the compartment door to transition from a closed position to an open position.

Clause 5: The extraction cleaner system further includes a finger slot attached to the compartment door and manually operable to move the compartment door from a closed position to an open position.

Clause 6: The compartment door is moveable between an open position, in which the pad compartment is accessible, and a closed position, in which the pad compartment is not accessible.

Clause 7: The compartment door is pivotably coupled with a portion of the suction nozzle.

Clause 8: The compartment door is fabricated from a substantially clear polymeric material through which is visible the absorbent pad.

Clause 9: The absorbent pad includes a pad assembly with a permeable pad body.

Clause 10: The pad assembly further includes a non-permeable shell that at least partially surrounds the pad body.

Clause 11: The pad body is elongated and defines therein at least one airflow channel that extends longitudinally through the pad body.

Clause 12: The pad assembly further includes first and second non-permeable plates attached to opposing first and second sides, respectively, of the pad body.

Clause 13: The pad assembly pad further includes a rigid frame encased therein and that buttresses the pad body.

Clause 14: The pad body includes an elongated liquid-absorbent strip and a permeable weave insert.

Clause 15: The pad assembly further includes a nozzle seal attached proximate one end of the pad body and defined therethrough a nozzle inlet of the suction nozzle.

Clause 16: The extraction cleaner system also includes a spray nozzle that is fluidly coupled with the fluid delivery pathway downstream from the liquid source. The spray nozzle is configured to dispense therethrough the liquid contained in the liquid source.

Clause 17: The cleaner housing includes a unitary body with a carry handle. The suction source, the liquid source, the suction nozzle, and the absorbent pad are all carried by the unitary body.

Clause 18: The extraction cleaner system includes a recovery tank attached to the cleaner housing and fluidly connected to the fluid recovery pathway downstream from the suction nozzle. The recovery tank is configured to removably store therein the liquid dispensed from the liquid source and drawn through the suction nozzle.

Clause 19: The extraction cleaner system includes an agitator attached adjacent the suction nozzle that is configured to agitate a surface to be cleaned by the extraction cleaner system.

Clause 20: The extraction cleaner system includes an accessory wand through which extends the fluid delivery pathway and the fluid recovery pathway, an accessory tool that is removably attachable to the accessory wand and contains the suction nozzle with the pad compartment removably storing therein the absorbent pad, and an accessory hose that fluidly connects the accessory wand to the suction source.

Clause 21: A handheld extraction cleaner includes a unitary body with a carry handle. The unitary body contains therein a fluid delivery pathway and a fluid recovery pathway. A rechargeable battery is carried by the unitary body and a suction source is mounted inside the unitary body, electrically connected to the rechargeable battery, and fluidly connected to the fluid recovery pathway. The suction source is configured to create a fluid pressure vacuum. A liquid source is mounted to the body and fluidly connected to the fluid delivery pathway and configured to contain and dispense therefrom a liquid cleaning solution. A suction nozzle is mounted to the unitary body and fluidly connected to the fluid recovery pathway upstream from the suction source. The suction nozzle is configured to draw therethrough the liquid cleaning solution dispensed from the liquid source. The suction nozzle defines therein a pad compartment located within the fluid recovery pathway. An absorbent pad is removably mounted inside the pad compartment.

Clause 22: A removable pad assembly for a vacuum cleaner system includes a recovery pathway, a suction source fluidly connected to the recovery pathway, and a suction nozzle fluidly connected to the recovery pathway upstream from the suction source that defines therein a pad compartment located within the recovery pathway. The removable pad assembly includes an elongated and absorbent pad body that defines therethrough an airflow pathway and configured to removably mount inside the pad compartment of the suction nozzle and a non-permeable outer layer at least partially surrounds the pad body.

Clause 23: The pad body is fabricated as a single-piece structure from a permeable material.

Clause 24: The non-permeable outer layer includes a non-permeable shell that at least partially surrounds the pad body.

Clause 25: The pad body defines therein at least one airflow channel that extends longitudinally through the elongated pad body.

Clause 26: The non-permeable outer layer includes first and second non-permeable plates attached to opposing first and second sides, respectively, of the pad body.

Clause 27: The removable pad assembly includes a rigid frame encased therein and that buttresses the pad body.

Clause 28: The pad body includes at least one elongated liquid-absorbent strip and a permeable weave insert.

Clause 29: The at least one elongated liquid-absorbent strip includes a plurality of absorbent strips that are mounted to and extend longitudinally along the permeable weave insert.

Clause 30: The removable pad assembly include a nozzle seal attached proximate one end of the pad body that defines therethrough a nozzle inlet of the suction nozzle.

Clause 31: A method of assembling an extraction cleaner system includes receiving a cleaner housing with a fluid delivery pathway and a fluid recovery pathway and attaching a suction source to the cleaner housing. The suction source is configured to create a fluid pressure vacuum. The method further includes fluidly connecting the suction source to the fluid recovery pathway and attaching a liquid source to the cleaner housing. The liquid source is configured to contain and dispense a liquid. Next, the method includes fluidly connecting the liquid source to the fluid delivery pathway and fluidly connecting a suction nozzle to the fluid recovery pathway upstream from the suction source. The suction nozzle is configured to draw therethrough the liquid dispensed from the liquid source and defines therein a pad compartment located within the fluid recovery pathway. The method then includes removably storing an absorbent pad inside the pad compartment.

Clause 32: The suction nozzle includes a compartment door disposed over the pad compartment that covers the absorbent pad.

Clause 33: The compartment door includes first and second pivot pins that project transversely from first and second sides, respectively, of the compartment door adjacent a longitudinal end thereof. The suction nozzle includes first and second pin slots that receive therein the first and second pivot pins, respectively, to thereby pivotably mount the compartment door to the suction nozzle.

Clause 34: The method further includes connecting an actuator trigger to the compartment door. The actuator trigger is manually operable to release the compartment door and thereby allow the compartment door to transition from a closed position to an open position.

Clause 35: The method of also includes attaching a finger slot to the compartment door. The finger slot is manually operable to move the compartment door from a closed position to an open position.

Clause 36: The compartment door is fabricated from a substantially clear polymeric material through which is visible the absorbent pad.

Clause 37: The absorbent pad includes a permeable and compressible pad body.

Clause 38: The absorbent pad further includes a non-permeable shell that surrounds the pad body.

Clause 39: The absorbent pad is elongated and defines therein an airflow channel that extends longitudinally through the pad body.

Clause 40: The absorbent pad further includes first and second non-permeable plates attached to opposing first and second sides, respectively, of the pad body.

Clause 41: The absorbent pad further includes a rigid frame encased therein that buttresses the pad body.

Clause 42: The pad body includes a plurality of elongated liquid-absorbent strips mounted to a permeable weave insert.

Clause 43: The absorbent pad further includes a nozzle seal attached to one end of the pad body that defines therethrough a nozzle inlet of the suction nozzle.

Clause 44: The method also includes fluidly connecting a spray nozzle to the fluid delivery pathway downstream from the liquid source. The spray nozzle is configured to dispense therethrough the liquid contained in the liquid source.

Clause 45: The cleaner housing includes a unitary body with a carry handle. The suction source, the liquid source, the suction nozzle, and the absorbent pad all mount in or to the unitary body.

Clause 46: The method also includes attaching a recovery tank to the cleaner housing. The recovery tank is configured to removably store therein the liquid dispensed from the liquid source and drawn through the suction nozzle. Next, the method includes fluidly connecting the recovery tank to the fluid recovery pathway downstream from the suction nozzle.

Clause 47: The method includes attaching an agitator adjacent the suction nozzle. The agitator is configured to agitate a surface to be cleaned by the extraction cleaner system.

Clause 48: A method of using an extraction cleaner system includes retrieving a cleaner housing with a fluid delivery pathway and a fluid recovery pathway, activating a suction source attached to the cleaner housing and fluidly connected to the fluid recovery pathway such that the suction source creates a fluid pressure vacuum within the fluid recovery pathway, and activating a liquid source attached to the cleaner housing and fluidly connected to the fluid delivery pathway such that the liquid source dispenses therefrom a cleaning liquid. The method then includes drawing through a suction nozzle, fluidly connected to the fluid recovery pathway upstream from the suction source, the cleaning liquid dispensed from the liquid source, the suction nozzle defining therein a pad compartment located within the fluid recovery pathway, and removing an absorbent pad from inside the pad compartment.

Clause 49: An extraction cleaner system includes a cleaner housing with a fluid recovery pathway. A suction source is disposed within the cleaner housing and fluidly connected to the fluid recovery pathway. The suction source is configured to create a fluid pressure vacuum. A suction nozzle is fluidly connected to the fluid recovery pathway upstream from the suction source and is configured to draw liquid therethrough from a surface being cleaned. The suction nozzle defines therein a pad compartment located within the fluid recovery pathway. An opening in the upstream (first) end of the pad compartment defines a nozzle inlet and an opening in the downstream (second) end of the pad compartment us fluidly coupled with the suction source. An absorbent pad is removably mounted inside the pad compartment, between the upstream end of the pad compartment and the downstream end of the pad compartment.

Clause 50: The suction nozzle includes a compartment door that is disposed over the pad compartment and covers the absorbent pad.

Clause 51: The compartment door includes first and second pivot pins that project transversely from first and second sides, respectively, of the compartment door adjacent a longitudinal end thereof. The suction nozzle includes first and second pin slots that receive therein the first and second pivot pins, respectively, to thereby pivotably mount the compartment door to the suction nozzle.

Clause 52: The extraction cleaner system further includes an actuator trigger connected to the compartment door and manually operable to release the compartment door and thereby allow the compartment door to transition from a closed position to an open position.

Clause 53: The extraction cleaner system further includes a finger slot attached to the compartment door and manually operable to move the compartment door from a closed position to an open position.

Clause 54: The compartment door is moveable between an open position, in which the pad compartment is accessible, and a closed position, in which the pad compartment is not accessible.

Clause 55: The compartment door is pivotably coupled with a portion of the suction nozzle.

Clause 56: The compartment door is fabricated from a substantially clear polymeric material through which is visible the absorbent pad.

Clause 57: The absorbent pad includes a pad assembly with a permeable pad body.

Clause 58: The pad assembly further includes a non-permeable shell that at least partially surrounds the pad body.

Clause 59: The pad body is elongated and defines therein at least one airflow channel that extends longitudinally through the pad body.

Clause 60: The pad assembly further includes first and second non-permeable plates attached to opposing first and second sides, respectively, of the pad body.

Clause 61: The pad assembly pad further includes a rigid frame encased therein and that buttresses the pad body.

Clause 62: The pad body includes an elongated liquid-absorbent strip and a permeable weave insert.

Clause 63: The pad assembly further includes a nozzle seal attached proximate one end of the pad body and defined therethrough a nozzle inlet of the suction nozzle.

Clause 64: The extraction cleaner system also includes a spray nozzle that is fluidly coupled with the fluid recovery pathway downstream from the liquid source. The spray nozzle is configured to dispense therethrough a liquid contained in a liquid source carried by the extraction cleaner system.

Clause 65: The cleaner housing includes a unitary body with a carry handle. The suction source, the liquid source, the suction nozzle, and the absorbent pad are all carried by the unitary body.

Clause 66: The extraction cleaner system includes a recovery tank attached to the cleaner housing and fluidly connected to the fluid recovery pathway downstream from the suction nozzle. The recovery tank is configured to removably store therein the liquid dispensed from the liquid source and drawn through the suction nozzle.

Clause 67: The extraction cleaner system includes an agitator attached adjacent the suction nozzle that is configured to agitate a surface to be cleaned by the extraction cleaner system.

Clause 68: The extraction cleaner system includes an accessory wand through which extends the fluid recovery pathway, an accessory tool that is removably attachable to the accessory wand and contains the suction nozzle with the pad compartment removably storing therein the absorbent pad, and an accessory hose that fluidly connects the accessory wand to the suction source.

While some representative modes have been described in detail above, various alternative designs may exist for practicing the present teachings defined in the appended claims. Those skilled in the art will recognize that modifications may be made to the disclosed embodiments without departing from the scope of the subject disclosure. Moreover, the present concepts expressly include combinations and sub-combinations of the described elements and features. The detailed description and the drawings are supportive and descriptive of the present teachings, with the scope of the present teachings defined solely by the claims.

What is claimed is:

1. An extraction cleaner system, comprising:

a housing with a fluid delivery pathway and a fluid recovery pathway;

a suction source disposed within the housing and fluidly connected to the fluid recovery pathway, the suction source configured to create a fluid pressure vacuum;

a liquid source carried by the housing and fluidly connected to the fluid delivery pathway, the liquid source configured to contain and dispense a liquid;

a suction nozzle fluidly connected to the fluid recovery pathway upstream from the suction source, the suction nozzle configured to draw therethrough the liquid dispensed from the liquid source, wherein the suction nozzle defines a pad compartment located within the fluid recovery pathway; and an absorbent pad removably stored inside the pad compartment such that a planar extent of the absorbent pad is parallel with a path of the suction nozzle at an opening of the suction nozzle at an underside of the housing, wherein the suction nozzle includes a compartment door disposed between the fluid delivery pathway and the fluid recovery pathway, the compartment door extending over the pad compartment to cover the absorbent pad.

2. The extraction cleaner system of claim 1, further comprising:

an actuator connected to the compartment door and manually operable to release the compartment door and thereby allow the compartment door to transition from a closed position to an open position.

3. The extraction cleaner system of claim 1, further comprising:

a finger slot attached to the compartment door and manually operable to move the compartment door from a closed position to an open position.

4. The extraction cleaner system of claim 1, wherein the compartment door is pivotably coupled with a portion of the suction nozzle.

5. The extraction cleaner system of claim 1, wherein the compartment door is fabricated from a transparent or translucent polymeric material through which the absorbent pad is visible.

6. The extraction cleaner system of claim 1, wherein the absorbent pad includes a pad assembly with a permeable pad body and a non-permeable shell at least partially surrounding the permeable pad body.

7. The extraction cleaner system of claim 6, wherein the permeable pad body is elongated and defines at least one airflow channel therein extending longitudinally through the permeable pad body.

8. The extraction cleaner system of claim 6, wherein the permeable pad body includes an elongated liquid-absorbent strip and a permeable weave insert.

9. The extraction cleaner system of claim 6, wherein the pad assembly further includes a nozzle seal attached proximate one end of the permeable pad body and defining a nozzle inlet of the suction nozzle.

10. The extraction cleaner system of claim 9, wherein the pad assembly includes a nozzle cap that is mounted to a distal end of the permeable pad body and defines a pad port that draws a cleaning solution, dirt, and other debris therethrough for absorption into the absorbent pad.

11. The extraction cleaner system of claim 10, further comprising:

an annular flange that projects transversely outward from a distal tip of the nozzle cap and bears a soft seal and a flexible seal ring.

12. The extraction cleaner system of claim 11, wherein the soft seal is mounted on an upper face of the annular flange, and wherein the soft seal sealing seats against an opposing bottom face of the pad port when the pad assembly is inserted into the pad compartment.

13. The extraction cleaner system of claim 11, wherein the flexible seal ring press-fits into the nozzle inlet thereby mechanically securing the absorbent pad to the suction nozzle.

14. The extraction cleaner system of claim 1, further comprising:

an accessory wand through which extends the fluid delivery pathway and the fluid recovery pathway;

an accessory tool removably attachable to the accessory wand and containing the suction nozzle with the pad compartment removably storing the absorbent pad; and an accessory hose fluidly connecting the accessory wand to the suction source.

15. The extraction cleaner system of claim 1, further comprising:

a recovery tank attached to the housing and fluidly connected to the fluid recovery pathway downstream from the suction nozzle, the recovery tank configured to removably store the liquid dispensed from the liquid source and drawn through the suction nozzle.

16. The extraction cleaner system of claim 1, further comprising:

an agitator attached adjacent the suction nozzle, the agitator configured to agitate a surface to be cleaned by said handheld extraction cleaner system.

* * * * *